US009589511B2

(12) United States Patent
Huang et al.

(10) Patent No.: US 9,589,511 B2
(45) Date of Patent: Mar. 7, 2017

(54) DRIVING BACKLIGHT METHOD, DISPLAY DEVICE AND STORAGE MEDIUM

(71) Applicants: HISENSE ELECTRIC CO., LTD., Qingdao, Shandong (CN); HISENSE USA CORPORATION, Suwanee, GA (US); HISENSE INTERNATIONAL CO., LTD., Qingdao, Shandong (CN)

(72) Inventors: Shunming Huang, Shandong (CN); Yuxin Zhang, Shandong (CN); Jianwei Cao, Shandong (CN); Mingsheng Qiao, Shandong (CN); Weidong Liu, Shandong (CN)

(73) Assignees: HISENSE ELECTRIC CO., LTD., Qingdao, Shandong (CN); HISENSE USA CORPORATION, Suwanee, GA (US); HISENSE INTERNATIONAL CO., LTD., Qingdao, Shandong (CN)

( * ) Notice: Subject to any disclaimer, the term of this patent is extended or adjusted under 35 U.S.C. 154(b) by 72 days.

(21) Appl. No.: 14/584,117

(22) Filed: Dec. 29, 2014

(65) Prior Publication Data

US 2016/0078830 A1 Mar. 17, 2016

(30) Foreign Application Priority Data

Sep. 16, 2014 (CN) ..... 2014 1 0471876

(51) Int. Cl.
*G09G 3/34* (2006.01)

(52) U.S. Cl.
CPC ... *G09G 3/3406* (2013.01); *G09G 2320/0257* (2013.01); *G09G 2320/064* (2013.01); *G09G 2320/0646* (2013.01); *G09G 2360/16* (2013.01)

(58) Field of Classification Search
CPC ..... G09G 3/3611; G09G 2320/0257; G09G 2320/064; G09G 2360/16; G09G 2320/0646
USPC ..... 345/691
See application file for complete search history.

(56) References Cited

U.S. PATENT DOCUMENTS

| | | | | |
|---|---|---|---|---|
| 8,120,569 | B2 * | 2/2012 | Jou | G09G 3/3406 345/102 |
| 2005/0248524 | A1 * | 11/2005 | Feng | G09G 3/3413 345/102 |
| 2006/0146005 | A1 * | 7/2006 | Baba | G09G 3/3233 345/102 |

(Continued)

*Primary Examiner* — Tom Sheng
(74) *Attorney, Agent, or Firm* — Boyle Fredrickson, S.C.

(57) ABSTRACT

The present disclosure provides a backlight driving method and device and a display device, wherein the backlight includes a plurality of backlight scanning areas, each luminous body corresponding to each backlight scanning area is driven independently, including: acquiring display gray scale of a current frame of image and that of a previous frame of image in a backlight scanning area; determining a first backlight duty ratio according to the display gray scale of the current frame and that of the previous frame; if black frame insertion time in the first backlight duty ratio is smaller than a first black frame insertion time, acquiring a second backlight duty ratio, wherein black frame insertion time in the second backlight duty ratio is not less than the first black frame insertion time; determining drive timing of the luminous bodies in the current frame according to the second backlight duty ratio.

19 Claims, 8 Drawing Sheets

(56) References Cited

U.S. PATENT DOCUMENTS

| | | | | |
|---|---|---|---|---|
| 2006/0152469 | A1* | 7/2006 | Hsu | G09G 3/3406 345/102 |
| 2007/0222744 | A1* | 9/2007 | Okita | G09G 3/342 345/102 |
| 2008/0042968 | A1* | 2/2008 | Oh | G09G 3/342 345/102 |
| 2008/0180385 | A1* | 7/2008 | Yoshida | G09G 3/20 345/102 |
| 2010/0045644 | A1* | 2/2010 | Lee | G09G 3/3233 345/208 |
| 2013/0321483 | A1* | 12/2013 | You | G09G 5/10 345/690 |
| 2014/0184485 | A1* | 7/2014 | Kim | G09G 3/3406 345/102 |

* cited by examiner

| K1 | The average value of the display gray scale of the current frame of image | | | | | | | | | |
|---|---|---|---|---|---|---|---|---|---|---|
| The average value of the display gray scale of the previous frame of image | | 0 | 8 | 16 | ... | ... | N | ... | ... | 255 |
| | 0 | 0 | 1% | | | | | | | x% |
| | 8 | -1% | 0 | 2% | | | | | | |
| | 16 | | -2% | 0 | 3% | | | | | |
| | ... | | | -3% | 0 | | | | | |
| | ... | | | | | 0 | | | | |
| | N | | | | | | 0 | | | |
| | ... | | | | | | | 0 | | |
| | ... | | | | | | | | 0 | |
| | 255 | -x% | | | | | | | | 0 |

DRIVING BACKLIGHT METHOD, DISPLAY DEVICE AND STORAGE MEDIUM

The present application claims priority to Chinese Patent Application No. 201410471876.4, filed with the State Intellectual Property Office of China on Sep. 16, 2014 and entitled "Backlight driving method, display device and storage medium", which is hereby incorporated by reference in its entirety.

FIELD OF THE INVENTION

The present disclosure relates to the field of display technologies, and particularly relates to backlight driving method, a display device and a storage medium.

BACKGROUND OF THE INVENTION

With rapid development of the display industry, the pursuit of visual impact effect of display is increasing with each passing day. However, existing display devices universally have a trailing phenomenon. The trailing phenomenon refers to edge burrs and detail invisibility when a display device displays a dynamic image, and this phenomenon is caused by the liquid crystal response time and the visual persistence characteristic of the human visual system.

Taking a liquid crystal display device as an example, as shown in FIG. 1, the solid line a is ideal liquid crystal response time, and the dashed line b is actual liquid crystal response time. The difference between the ideal liquid crystal response time and the actual liquid crystal response time is the liquid crystal response time. Generally, the shorter the liquid crystal response time is, the less obvious the trailing phenomenon is. FIG. 2 is a schematic diagram of the visual persistence characteristic of the human visual system. When light enters human eyes, the response time between a light pulse signal c acting on the human eyes and a human visual receiving signal d within the time t0-t1 is t0-t2, a response time is aroused within the time t0-t1 due to the visual inertia, and a visual persistence is aroused within the time t1-t2, so the trailing phenomenon is produced.

In the prior art, on the one hand, the rotating speed of liquid crystals is increased in an overvoltage driving manner to shorten the liquid crystal response time and alleviate the trailing phenomenon caused by the liquid crystal response time. On the other hand, the trailing phenomenon caused by the visual persistence characteristic of the human visual system is alleviated by black frame insertion. One of existing black frame insertion manners is to insert a black field between original normal two frames of images, so that the original $N^{th}$ frame of image and $(N+1)^{th}$ frame of image become current $N^{th}$ frame of image, $(N+1)^{th}$ frame of black field and $(N+2)^{th}$ frame of image, at this moment, for the human eyes the visual persistence effect of the $N^{th}$ frame of image mostly appears in the $(N+1)^{th}$ frame of black field, and the persistence effect of the $N^{th}$ frame of image on the $(N+2)^{th}$ frame of image is much smaller, in this way, the trailing phenomenon may be alleviated.

SUMMARY OF THE INVENTION

In one aspect, one embodiment of the present invention provides a backlight driving method. The backlight driving method is used for driving a backlight of a liquid crystal display device, the backlight includes a plurality of backlight scanning areas, each luminous body corresponding to each backlight scanning area is driven independently, and the method includes:

acquiring display gray scale of a current frame of image and display gray scale of a previous frame of image in a backlight scanning area;

determining a first backlight duty ratio according to the display gray scale of the current frame of image and the display gray scale of the previous frame of image;

if black frame insertion time in the first backlight duty ratio is smaller than a first black frame insertion time, acquiring a second backlight duty ratio, wherein black frame insertion time in the second backlight duty ratio is greater than or equal to the first black frame insertion time, and the first black frame insertion time is not less than 20% of a frame period;

determining drive timing of the luminous bodies of the backlight scanning area in the current frame according to the second backlight duty ratio.

In another aspect, one embodiment of the present invention provides a display device including: one or more processors; one or more computer-readable memories;

the one or more computer-readable memories storing instruction codes, the instruction codes are executable by the one or more processors to drive a backlight of liquid crystal of the display device, and the backlight includes a plurality of backlight scanning areas, wherein each luminous body corresponding to each backlight scanning area is driven independently, including:

acquiring display gray scale of a current frame of image and display gray scale of a previous frame of image in a backlight scanning area;

determining a first backlight duty ratio according to the display gray scale of the current frame of image and the display gray scale of the previous frame of image;

if the black frame insertion time in the first backlight duty ratio is smaller than a first black frame insertion time, acquiring a second backlight duty ratio, wherein black frame insertion time in the second backlight duty ratio is greater than or equal to the first black frame insertion time, and the first black frame insertion time is not less than 20% of a frame period;

determining drive timing of the luminous bodies of the backlight scanning area in the current frame according to the second backlight duty ratio.

In a further aspect, one embodiment of the present invention provides a computer-readable storage medium storing computer-readable program codes, and the computer-readable program codes are executable by one or more processors to drive a backlight of the liquid crystal display device, including:

acquiring display gray scale of a current frame of image and display gray scale of a previous frame of image in a backlight scanning area;

determining a first backlight duty ratio according to the display gray scale of the current frame of image and the display gray scale of the previous frame of image;

if the black frame insertion time in the first backlight duty ratio is smaller than a first black frame insertion time, acquiring a second backlight duty ratio, wherein black frame insertion time in the second backlight duty ratio is greater than or equal to the first black frame insertion time, and the first black frame insertion time is not less than 20% of a frame period;

determining drive timing of the luminous bodies of the backlight scanning area in the current frame according to the second backlight duty ratio.

BRIEF DESCRIPTION OF THE DRAWINGS

To describe technical solutions in embodiments of the present invention or in the prior art more clearly, the drawings used in the description of embodiments or the prior art is introduced briefly below. Apparently, these drawings in the description below are merely some embodiments of the present invention, and other drawings may also be obtained by those of ordinary skill in the art based on these drawings without any creative effort.

DETAILED DESCRIPTION OF THE EMBODIMENTS

A clear and complete description of technical solutions of embodiments of the present invention will be given below, in combination with the accompanying drawings in embodiments of the present invention. Apparently, the described embodiments are merely a part, but not all, of embodiments of the present invention. All of other embodiments, obtained by those of ordinary skill in the art based on embodiments of the present invention without any creative efforts, fall into the protection scope of the present invention.

Figure 1:
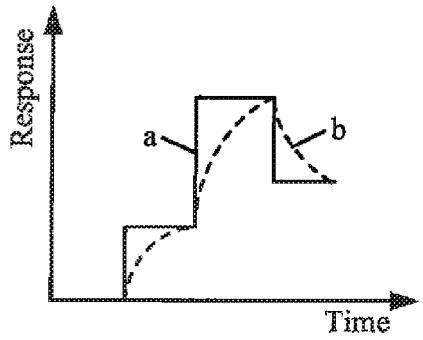
FIG. 1 is a schematic diagram of ideal liquid crystal response time and actual liquid crystal response time in the prior art.
Figure 2:
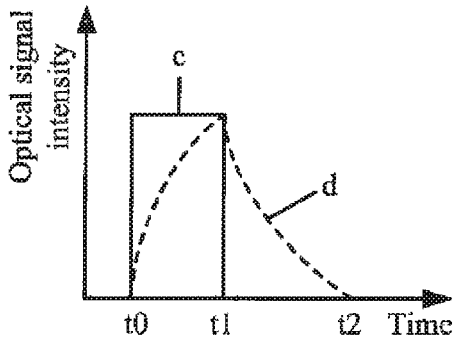
FIG. 2 is a schematic diagram of the visual persistence characteristic of the human visual system.
Figure 3:
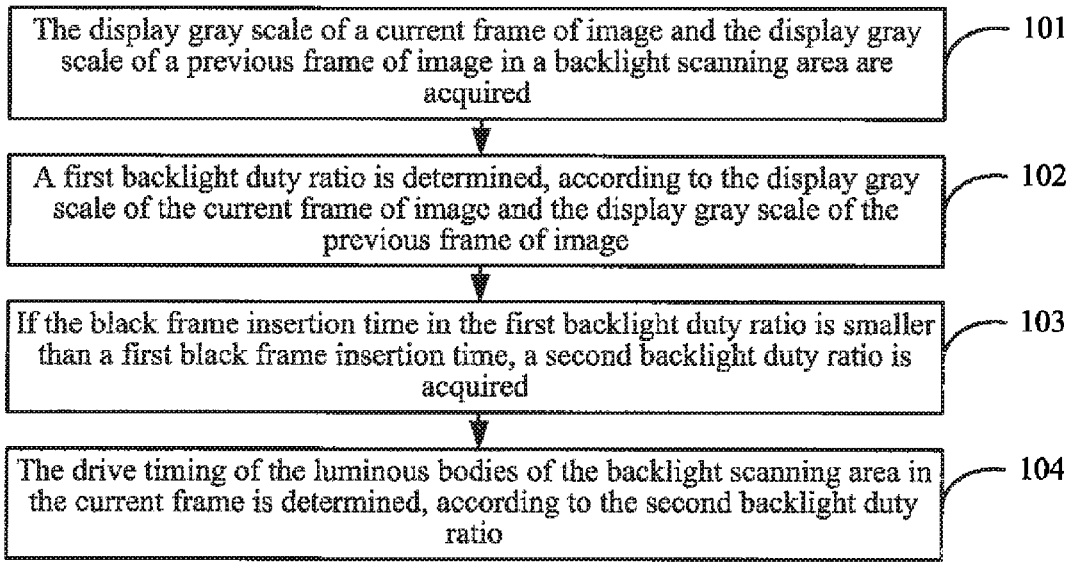
FIG. 3 is a schematic diagram of a backlight driving method, provided by one embodiment of the present invention.

An embodiment of the present invention provides a backlight driving method. The method is used for driving a backlight of a liquid crystal display device, the backlight includes a plurality of backlight scanning areas, and each luminous body corresponding to each backlight scanning area is driven independently, namely the same drive timing is applied to the luminous bodies in the same backlight scanning area, and different drive timings may be applied to the luminous bodies in different backlight scanning areas. As shown in FIG. 3, the driving method includes the following operations.

Operation 101, the display gray scale of a current frame of image and the display gray scale of a previous frame of image in a backlight scanning area are acquired.

In one embodiment, the display gray scale of the current frame of image and the display gray scale of the previous frame of image in the backlight scanning area are acquired, namely the display gray scales of each display unit (pixel unit) in a display area corresponding to the backlight scanning area in the current frame of image and the previous frame of image are acquired, wherein acquisition of the display gray scale of the previous frame of image in the backlight scanning area may be acquisition of the display gray scale of the previous frame of image stored in a system.

Operation 102, a first backlight duty ratio is determined, according to the display gray scale of the current frame of image and the display gray scale of the previous frame of image.

In one embodiment, the average value of the display gray scale of the current frame of image and the average value of the display gray scale of the previous frame of image are calculated according to the display gray scale of the current frame of image and the display gray scale of the previous frame of image, and the first backlight duty ratio may be determined by looking up a lookup table or the like according to the average value of the display gray scale of the current frame of image and the average value of the display gray scale of the previous frame of image.

Moreover, the first backlight duty ratio may also be determined according to the display gray scale of the current frame of image and the display gray scale of the previous frame of image by determining other gray scale characteristic values of the images, such as weighted values, and one embodiment of the present invention is not specifically limited thereto.

Operation 103, if the black frame insertion time in the first backlight duty ratio is smaller than a first black frame insertion time, a second backlight duty ratio is acquired, wherein the black frame insertion time in the second backlight duty ratio is greater than or equal to the first black frame insertion time, and the first black frame insertion time is not less than 20% of a frame period.

The frame period is a scanning period of scan lines on a display panel, and is related to the scanning frequency. For example, if the scanning frequency of the display panel is 120 Hz, the scanning period T is equal to $1/120$ Hz, about 8.3 ms. The backlight duty ratio is the ratio of the backlight (luminous body) lightening time in the frame period to the frame period, and the black frame insertion time in the backlight duty ratio is the difference between the frame period and the backlight lightening time in the frame period. For example, the backlight duty ratio is 30%, namely the backlight (luminous body) lightening time in the frame period is 8.3 ms*30%, that is 2.49 ms, and at the moment, the black frame insertion time in the backlight duty ratio is 8.3 ms−2.49 ms=5.81 ms.

The first black frame insertion time is not less than 20% of the frame period, taking the above-mentioned scanning period being 8.3 ms as an example, namely the first black frame insertion time is not less than 8.3 ms*20%, in other words, the first black frame insertion time is not less than 1.66 ms. The first black frame insertion time being not less than 1.66 ms refers to that the first black frame insertion time may be any value more than 1.66 ms, e.g. the first black frame insertion time may be 2 ms or 2.2 ms. As when the first black frame insertion time is less than 20% of the frame period, the black frame insertion time in the frame period may be too short to alleviate the trailing phenomenon, in one embodiment of the present invention the first black frame insertion time is not less than 20% of the frame period. In addition, the longer the first black frame insertion time is, the shorter the corresponding lightening time is, so overlong first black frame insertion time may affect the display effect. In one embodiment of the present invention, the first black frame insertion time is not less than 20% of the frame period and not more than 50% of the frame period. Further, the first black frame insertion time is not less than 30% of the frame period and not more than 50% of the frame period, so that the black frame insertion effect and the display effect are better. Moreover, for different liquid crystal display devices, due to different scanning frequency, the corresponding frame period is different, and the first black frame insertion time is also different. In one embodiment of the present invention, the first black frame insertion time is a preset value corresponding to a display device. The embodiments of the present invention are all described in detail by taking the example that the scanning frequency of the display device is 120 Hz, the scanning period is 8.3 ms and the preset first black frame insertion time is 2 ms.

As shown above, if the black frame insertion time in the first backlight duty ratio is smaller than the first black frame insertion time, the second backlight duty ratio is acquired, wherein the black frame insertion time in the second backlight duty ratio is more than or equal to the first black frame insertion time. The trailing phenomenon may be alleviated by setting the black frame insertion time in the second backlight duty ratio to be more than or equal to the first black frame insertion time. That is, in the case where the trailing phenomenon cannot be alleviated by the black frame insertion time in the first backlight duty ratio, the second backlight duty ratio is acquired. For example, the scanning frequency of the display device is 120 Hz, the scanning period is 8.3 ms, the preset first black frame insertion time is 2 ms, and if the first backlight duty ratio is 80%, the black frame insertion time in the first backlight duty ratio is 1.66 ms which is smaller than the first black frame insertion time. In this case, the second backlight duty ratio is acquired, the second backlight duty ratio may be 70%, and then the black frame insertion time in the second backlight duty ratio is 2.49 ms which is greater than the first black frame insertion time (2 ms), so the trailing phenomenon may be alleviated by setting the black frame insertion time in the second backlight duty ratio in such a manner.

In addition, it should be noted that in one embodiment of the present invention, if the black frame insertion time in the first backlight duty ratio is greater than or equal to the first black frame insertion time, the drive timing of the backlight scanning area in the current frame is determined according to the first backlight duty ratio. The drive timing in the case where the black frame insertion time in the first backlight duty ratio is greater than or equal to the first black frame insertion time will be described in detail below.

Operation 104, determining the drive timing of the luminous bodies of the backlight scanning area in the current frame according to the second backlight duty ratio.

It should be noted that, the drive timing of the luminous bodies of the backlight scanning area in the current frame includes the lightening (namely high level) and black frame insertion (namely low level) timing of the luminous bodies of the backlight scanning area in the current frame, and the lengths of the lightening time and black frame insertion time. Moreover, when the backlight duty ratio is determined, the lengths of the lightening time and the black frame insertion time of the luminous bodies are determined. For example, when the backlight duty ratio is 70%, the lightening time of the luminous bodies in the second backlight duty ratio is 5.81 ms, and the black frame insertion time of the luminous bodies in the second backlight duty ratio is 2.49 ms. At the moment, black frame insertion is performed for 2.49 ms after the luminous bodies are lightened for 5.81 ms in the frame period, or the luminous bodies are lightened for 5.81 ms after black frame insertion is performed for 2.49 ms in the frame period, or after black frame insertion is performed for 1 ms, the luminous bodies are lightened for 5.81 ms, and then black frame insertion is performed for 1.49 ms in the frame period. Under the condition that the sum of the black frame insertion time of the luminous bodies in the frame period is 2.49 ms and the luminous bodies are lightened for 5.81 ms, the time length of each black frame insertion and lightening may take various different forms.

According to the backlight driving method provided by one embodiment of the present invention, when the black frame insertion time in the first backlight duty ratio determined according to the display gray scale of the current frame of image and the display gray scale of the previous frame of image in the backlight scanning area is too short and smaller than the first black frame insertion time, the black frame insertion effect is not achieved and the trailing phenomenon cannot be alleviated, the drive timing of the luminous bodies of the backlight scanning area in the current frame is determined according to the second backlight duty ratio, and since the black frame insertion time in the second backlight duty ratio is greater than the first black frame insertion time, the trailing phenomenon may be alleviated by the drive timing of the luminous bodies of the backlight scanning area, determined according to the second backlight duty ratio.

Alternatively, in the case where the black frame insertion time in the second backlight duty ratio is equal to the first black frame insertion time, determining the drive timing of the luminous bodies of the backlight scanning area in the current frame according to the second backlight duty ratio includes: determining the drive timing of the luminous bodies of the backlight scanning area in the current frame as follows: keeping a low level (namely the luminous bodies are turned off for black frame insertion) for the first black frame insertion time since the start of scanning of the first scan line of the display area corresponding to the backlight scanning area, and then keeping a high level (namely the luminous bodies are lightened) till next frame of scanning begins on the first gate line of the display area corresponding to the backlight scanning area.

It should be noted that, since the backlight scanning area corresponds to the display area of the display panel, display of the display area refers to that the corresponding scan lines of the display area are sequentially turned on. In one embodiment of the present invention, keeping a low level for the first black frame insertion time since start of scanning of the first scan line of the display area corresponding to the backlight scanning area refers to performing black frame insertion by taking the time of starting scanning of the first scan line of the display area corresponding to the backlight scanning area as a starting time of the drive timing of the backlight scanning area, and then keeping a high level till next frame of scanning begins on the first gate line of the display area corresponding to the backlight scanning area refers to keeping a high level till next frame of scanning begins, wherein the total lightening and black frame insertion time of the luminous bodies is equal to a frame period.

Figure 4:
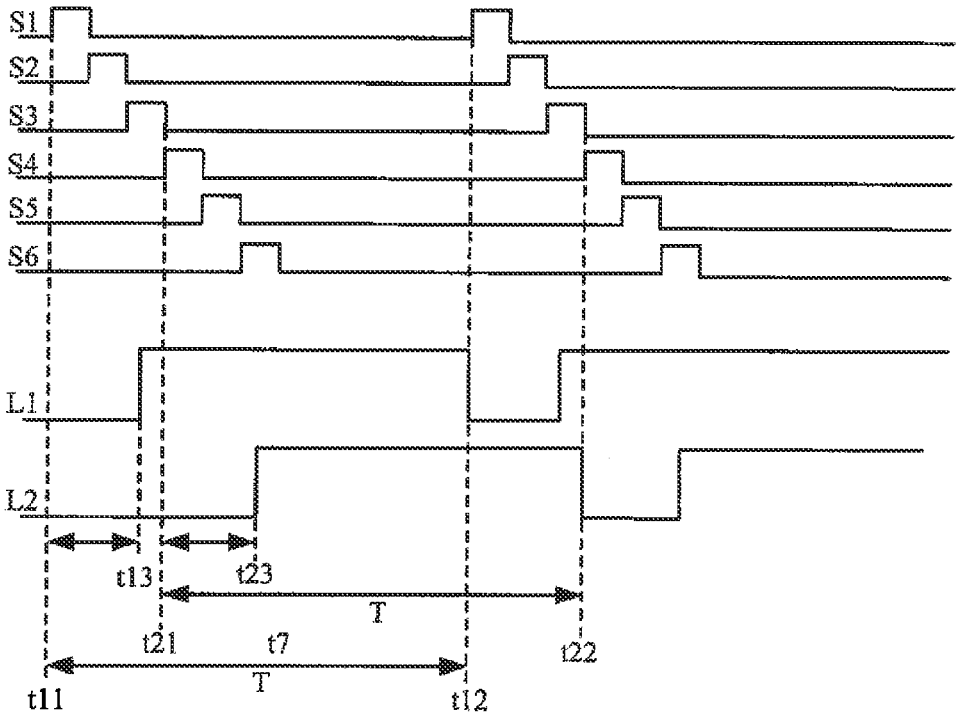
FIG. 4 is a schematic diagram of a scanning timing of a backlight scanning area and a scanning timing of a display area provided by one embodiment of the present invention.

For example, the second backlight duty ratio is 70%, the lightening time of the luminous bodies in the second backlight duty ratio is 5.81 ms, and the black frame insertion time of the luminous bodies in the second backlight duty ratio is 2.49 ms. As shown in FIG. 4, when the scan lines included in the display area corresponding to the backlight scanning area L1 are S1-S3, the display area corresponding to the backlight scanning area L2 includes scan lines S4-S6. By taking the example that the second backlight duty ratio of the backlight scanning area L1 and the backlight scanning area L2 is 70%, scanning of the scan line S1 begins at the moment t11, the frame period of the backlight scanning area L1 is t11-t12 (i.e. 8.3 ms), then at the moment t11 luminous body black frame insertion (low level) is performed on the luminous bodies of the corresponding backlight scanning area L1 for 2.49 ms, namely black frame insertion is performed on the backlight from the moment t11 to the moment t13, and the luminous bodies are lightened (high level) for 5.81 ms from the moment t13, namely the backlight is lightened from the moment t13 to the moment t12. Scanning of the scan line S4 begins at the moment t21, the frame period of the backlight scanning area L2 is t21-t22 (i.e. 8.3 ms), then at the moment t21 luminous body black frame insertion (low level) is performed on the luminous bodies of the corresponding backlight scanning area L2 for 2.49 ms, namely black frame insertion is performed on the backlight from the moment t21 to the moment t23, and the luminous bodies are lightened (high level) for 5.81 ms from the moment t23, namely the backlight is lightened from the moment t23 to the moment t22.

When a scan line is scanned, the corresponding liquid crystals deflect, namely the liquid crystals respond; after the liquid crystals deflect to a certain angle, the angle is kept till the next frame of gate line is scanned; and within the deflecting time of the liquid crystals, the display is instable. According to the method provided by one embodiment of the present invention, a low level is kept for the first black frame insertion time when the display area corresponding to the backlight scanning area begins to be scanned, namely black frame insertion is performed within the deflecting time of the liquid crystals, and a high level is kept all the time within the stable time of the liquid crystals after the liquid crystals deflect to a certain angle, which is conducive to the stability of display and further improves the display effect.

Figure 5:
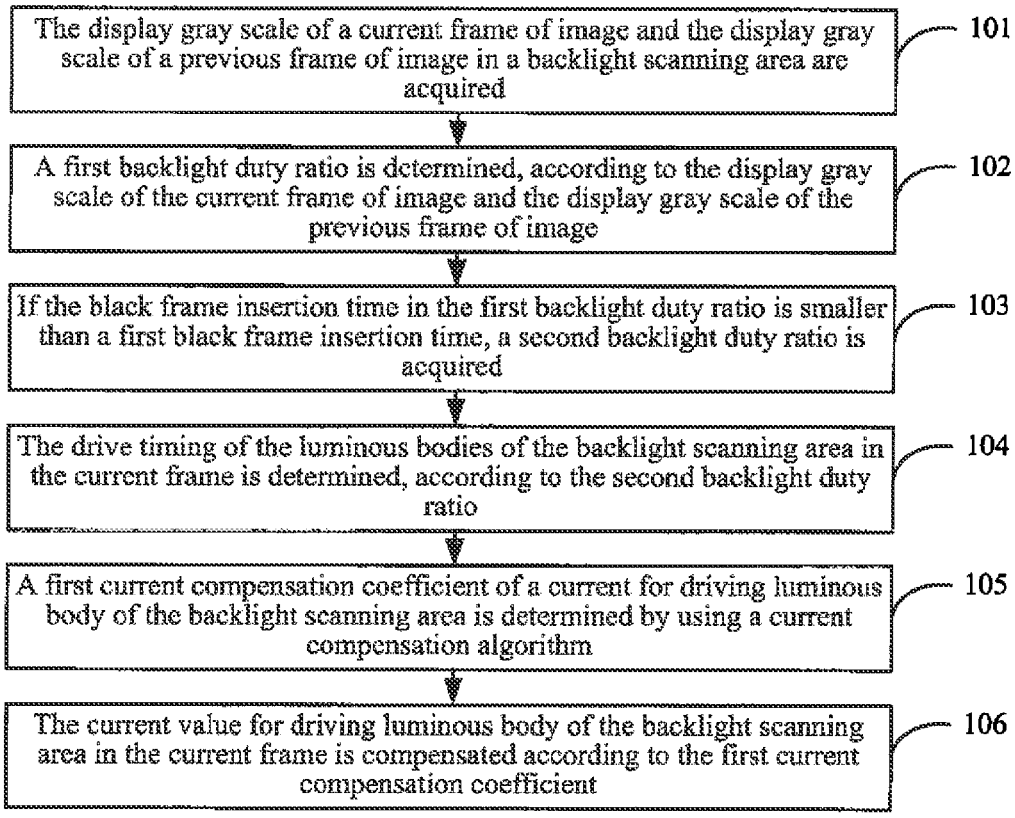
FIG. 5 is a schematic diagram of another backlight driving method, provided by one embodiment of the present invention.

In one embodiment of the present invention, as shown in FIG. 5, the method further includes the following operations.

Operation 105, a first current compensation coefficient of a current for driving luminous body of the backlight scanning area is determined by using a current compensation algorithm, wherein the current compensation algorithm is as follows:

$$K1 = \frac{T * D1}{T - t} * \frac{1}{D2}$$

wherein D2 represents the second backlight duty ratio, T represents the frame period, D1 represents the first backlight duty ratio, t represents the first black frame insertion time, and K1 represents the first current compensation coefficient.

It should be noted that in the prior art, the current compensation coefficient of the backlight scanning area is generally determined according to the average of the display gray scales of the current frame of image and the average of the display gray scales of a previous frame of image in the backlight scanning area. The first current compensation coefficient of the backlight scanning area is determined by using the current compensation algorithm in one embodiment of the present invention.

If the black frame insertion time in the first backlight duty ratio is smaller than the first black frame insertion time, the second backlight duty ratio is acquired, and the black frame insertion time in the second backlight duty ratio is greater than or equal to the first black frame insertion time. Due to the same frame period, the backlight lightening time in the first backlight duty ratio is greater than that in the second backlight duty ratio, namely the second backlight duty ratio D2 is smaller than the first backlight duty ratio D1.

That is, in the above current compensation algorithm, $$\frac{T}{T - t} > 1, \text{ and } \frac{D1}{D2} > 1,$$

then K1>1, and the first current compensation coefficient is more than 1, namely the current is improved.

Operation 106, the current value for driving luminous body of the backlight scanning area in the current frame is compensated according to the first current compensation coefficient.

In one embodiment of the present invention, the black frame insertion time in the second backlight duty ratio is longer than that in the first backlight duty ratio, and compared with the first backlight duty ratio, the brightness of backlight scanning performed according to the second backlight duty ratio is lower than that performed according to the first backlight duty ratio. Accordingly, in one embodiment of the present invention, the current value for driving luminous body of the backlight scanning area in the current frame is compensated according to the first current compensation coefficient, namely the brightness of the backlight is improved by improving the current.

Figures 6, 7:
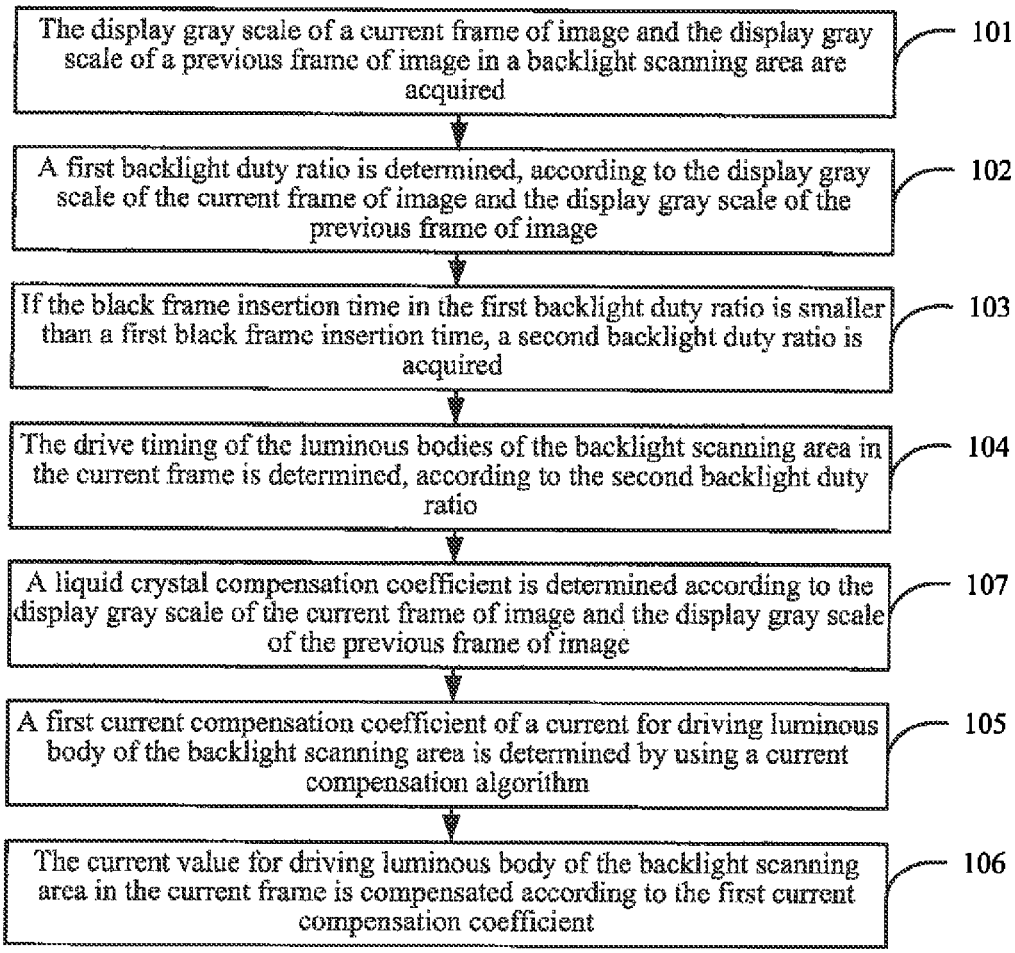
FIG. 6 is a schematic diagram of another backlight driving method, provided by one embodiment of the present invention.
FIG. 7 is a schematic diagram of a lookup table provided by one embodiment of the present invention.

In one embodiment of the present invention, as shown in FIG. 6, the method further includes the following operations.

Operation 107, a liquid crystal compensation coefficient is determined according to the display gray scale of the current frame of image and the display gray scale of the previous frame of image.

In one embodiment, operation 107 may be obtaining the average value of the display gray scale of the current frame of image and the average value of the display gray scale of the previous frame of image in the backlight scanning area according to the display gray scale of the current frame of image and the display gray scale of the previous frame of image in the backlight scanning area in operation 101, and determining the liquid crystal compensation coefficient according to the average value of the display gray scale of the current frame of image and the average value of the display gray scale of the previous frame of image by looking up a lookup table shown in FIG. 7.

For example, the average value of the display gray scale of the current frame of image is 8, the average value of the display gray scale of the previous frame of image is 0, and the liquid crystal compensation coefficient is determined as 1% by looking up the lookup table shown in FIG. 7. That is, when the average value of the display gray scale of the current frame of image is greater than that of the previous frame of image, because the backlight brightness within the liquid crystal response time is lower than a target brightness, the liquid crystal compensation coefficient more than 0 is favorable for improving the backlight brightness. The average value of the display gray scale of the current frame of image is 0, the average value of the display gray scale of the previous frame of image is 8, and the liquid crystal compensation coefficient is determined as −1% by looking up the lookup table shown in FIG. 7. That is, when t the average value of the display gray scale of the current frame of image is smaller than the average value of the display gray scale of the previous frame of image, because the backlight brightness within the liquid crystal response time is higher than the target brightness, the liquid crystal compensation coefficient less than 0 is favorable for reducing the backlight compensation brightness.

Figure 8:
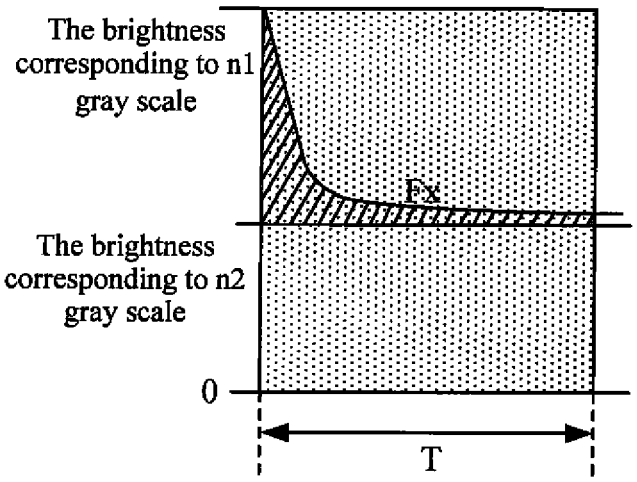
FIG. 8 is a schematic diagram of a current compensation algorithm principle provided by one embodiment of the present invention.

It should be noted that the first current compensation coefficient K1 in FIG. 7 is equal to a/A, and with reference to FIG. 8, Fx=f(n1,n2), and n2 represents the display gray scale of the current frame of image, n1 represents the display gray scale of the previous frame of image, a is the area of an oblique line zone in FIG. 8, and A is the area of a background filling zone.

It should be noted that FIG. 7 shows a 8 bit mapping mode, moreover, it may also show a 10 bit mapping mode, a 12 bit mapping mode or other mapping modes, and the 8 bit mapping mode is only taken as an example for detailed description in embodiments of the present invention.

Operation 105, the first current compensation coefficient of a current for driving luminous body of the backlight scanning area is determined by using a current compensation algorithm, wherein the current compensation algorithm is as follows:

$$K1 = \left(\frac{T * D1}{T - t} + E\right) * \frac{1}{D2}$$

wherein D2 represents the second backlight duty ratio, T represents the frame period, D1 represents the first backlight duty ratio, t represents the first black frame insertion time, K1 represents the first current compensation coefficient, and E represents the liquid crystal compensation coefficient.

In the above-mentioned current compensation algorithm, $$K1 = \left(\frac{T * D1}{T - t} + E\right) * \frac{1}{D2} = \frac{T * D1}{T - t} * \frac{1}{D2} + \frac{E}{D2}, \frac{T}{T - t} > 1,$$

$$\text{and } \frac{D1}{D2} > 1, \text{ then } \frac{T * D1}{T - t} * \frac{1}{D2} > 1,$$

and the liquid crystal compensation coefficient E is obtained by looking up a lookup table. When E is positive, namely the average value of the display gray scale of the previous frame of image is smaller than the average value of the display gray scale of the current frame of image, the compensation of brightness is relatively high, which is therefore favorable for improving the backlight brightness; when E is negative, namely the average value of the display gray scale of the previous frame of image is greater than the average value of the display gray scale of the current frame of image, the compensation of brightness is relatively low, and the smaller E is, namely the larger the average value of the display gray scale of the previous frame of image is than that of the current frame of image, the smaller the compensation coefficient of the brightness is, so as to be favorable for reducing the brightness of backlight compensation.

The liquid crystal compensation coefficient E is obtained by looking up a lookup table shown in FIG. 7. For example, the average value of the display gray scale of the current frame of image is 8, the average value of the display gray scale of the previous frame of image is 0, and the liquid crystal compensation coefficient is determined as 1% by looking up the lookup table shown in FIG. 7. The average value of the display gray scale of the current frame of image is greater than that of the previous frame of image, and because the backlight brightness within the liquid crystal response time is lower than a target brightness, compared with the case where there is no liquid crystal compensation coefficient, this embodiment further increases the first current compensation coefficient, so as to be favorable for improving the backlight brightness. The average value of the display gray scale of the current frame of image is 0, the average value of the display gray scale of the previous frame of image is 8, the liquid crystal compensation coefficient is determined as −1% by looking up the lookup table shown in FIG. 7, namely the average value of the display gray scale of the current frame of image is greater than that of the previous frame of image, and because the backlight brightness within the liquid crystal response time is higher than the target brightness, compared with the case where there is no liquid crystal compensation coefficient, this embodiment further reduces the first current compensation coefficient, so as to be favorable for reducing the brightness of backlight compensation.

Operation 106, the current value for driving luminous body of the backlight scanning area in the current frame is compensated according to the first current compensation coefficient.

Alternatively, in the case where the black frame insertion time in the second backlight duty ratio is greater than the first black frame insertion time, the first black frame insertion time is not more than 50% of the frame period.

Determining the drive timing of the luminous bodies of the backlight scanning area in the current frame according to the second backlight duty ratio includes: determining the drive timing of the luminous bodies of the backlight scanning area in the current frame as follows: keeping a low level for a first time since the start of scanning of the first scan line of the display area corresponding to the backlight scanning area, and then keeping a high level till next frame of scanning begins on the first gate line of the display area corresponding to the backlight scanning area, wherein the first time is the black frame insertion time in the second backlight duty ratio.

For example, the second backlight duty ratio is 70%, the lightening time in the second backlight duty ratio is 5.81 ms, the black frame insertion time in the second backlight duty ratio is 2.49 ms, then the drive timing of the luminous bodies of the backlight scanning area in the current frame is determined according to the second backlight duty ratio as follows: since the start of scanning the first scan line of the display area corresponding to the backlight scanning area, keeping a low level, namely performing black frame insertion on the backlight for 2.49 ms, then keeping a high level till next frame of scanning begins on the first gate line of the display area corresponding to the backlight scanning area, namely lightening the backlight for 5.81 ms. That is, only one-time black frame insertion is performed in the drive timing of the luminous bodies in the current frame, and the black frame insertion time is equal to the black frame insertion time in the second backlight duty ratio, so that the liquid crystals deflect within the black frame insertion time as far as possible, so as to solve the display problems brought by the deflection of the liquid crystals, and be favorable for improving the display effect.

Or, the drive timing of the luminous bodies of the backlight scanning area in the current frame is determined as follows: since the start of scanning of the first scan line of the display area corresponding to the backlight scanning area, keeping a low level for the first black frame insertion time, then keeping a high level for a second time, and keeping a low level for a third time; wherein the second time is the lightening time in the second backlight duty ratio, and the third time is the difference between the black frame insertion time in the second backlight duty ratio and the first black frame insertion time.

For example, the second backlight duty ratio is 70%, the lightening time in the second backlight duty ratio is 5.81 ms, the black frame insertion time in the second backlight duty ratio is 2.49 ms, and the first black frame insertion time is 2 ms, and at the moment, the drive timing of the luminous bodies of the backlight scanning area in the current frame according to the second backlight duty ratio is determined as follows: since the start of scanning of the first scan line of the display area corresponding to the backlight scanning area, keeping a low level, namely performing black frame insertion on the backlight for 2 ms; then keeping a high level for the second time, namely lightening the backlight for 5.81 ms; and keeping a low level for the third time, namely performing black frame insertion again on the backlight for 0.49 ms.

It should be noted that in operation 105 of both the method shown in FIG. 5 and the method shown in FIG. 6, the first current compensation coefficient of the current for driving luminous body of the backlight scanning area is determined by using the current compensation algorithm, but the current compensation algorithm shown in FIG. 6 is different from that shown in FIG. 5. The liquid crystal compensation coefficient is further introduced into the current compensation algorithm shown in FIG. 6, to further accurately determine the first compensation coefficient of the current for driving luminous body according to the display gray scale of the previous frame of image and the display gray scale of the current frame of image, and if the display gray scale of the current frame of image is greater than that of the previous frame of image, the first compensation coefficient is further improved, to further improve the brightness; and if the display gray scale of the current frame of image is smaller than that of the previous frame of image, the first compensation coefficient is slightly reduced, to further reduce the brightness of compensation and improve the display quality.

In one embodiment of the present invention, in the method shown in FIG. 3, operation 103 of acquiring the second backlight duty ratio may further be: acquiring the second backlight duty ratio through a duty ratio algorithm, wherein the duty ratio algorithm is as follows:

$$D2 = \frac{T * D1}{T - t} * \frac{1}{K2}$$

wherein D2 represents the second backlight duty ratio, T represents the frame period, D1 represents the first backlight duty ratio, t represents the first black frame insertion time, and K2 represents the second current compensation coefficient.

For example, t/T=20%, K=2, then D2=5D1/8, namely D2 is smaller than D1, the black frame insertion time in the second backlight duty ratio is greater than that in the first backlight duty ratio, and black frame insertion is performed on the scanning area by using the second backlight duty ratio, so that the trailing phenomenon may be alleviated.

The principle of the duty ratio algorithm will be described in detail below: T represents frame period, t represents black frame insertion time, the duty ratio of D is 100%, Br represents the corresponding standard brightness of D, D' represents adjusted duty ratio, Br' represents brightness of corresponding D', and K represents compensation coefficient. When Br'=K*Br through multiple improvement of brightness, the actual brightness $$B = \frac{T * D}{T - t} * Br = \frac{T * D}{T - t} * \frac{Br'}{K} *= D' * Br',$$

and thus, $$D' = \frac{T * D}{T - t} * \frac{1}{K}.$$

For example, D=50%, t=0.9 ms, T=8.3 ms, K=2, and D'=35.7% is obtained according to the above formula. Other duty ratio algorithms and current compensation coefficient algorithms may be derived with reference to the above description, which is not redundantly described in embodiments of the present invention.

Figure 9:
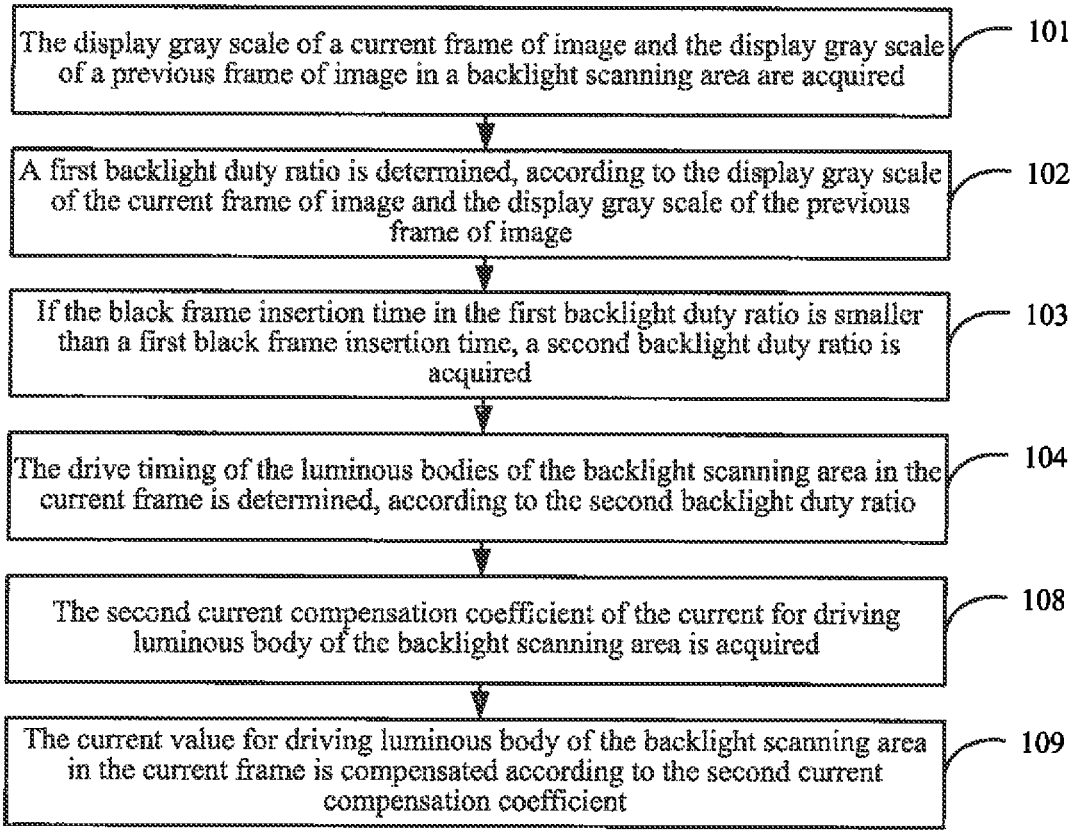
FIG. 9 is a schematic diagram of another backlight driving method, provided by one embodiment of the present invention.

As shown in FIG. 9, the method further includes the following operations.

Operation 108, the second current compensation coefficient of the current for driving luminous body of the backlight scanning area is acquired, wherein the second current compensation coefficient is a preset compensation coefficient.

For example, the second current compensation coefficient is set to be 2, namely the current is improved by 2 times. Of course, for different displays, the second current compensation coefficient may also be set to be 1.5 or 3 or the like. The embodiment of the present invention is described in detail by taking the second current compensation coefficient being 2 as an example.

Operation 109, compensating the current value for driving luminous body of the backlight scanning area in the current frame by using the second current compensation coefficient.

In one embodiment, reference may be made to the description of compensating the current value for driving luminous body of the backlight scanning area in the current frame by using the first current compensation coefficient in operation 106, which is not redundantly described herein.

In one embodiment of the present invention, in the method shown in FIG. 3, operation 103 of acquiring the second backlight duty ratio is: acquiring the second backlight duty ratio through a duty ratio algorithm, wherein the duty ratio algorithm is as follows:

$$D2 = \left(\frac{T * D1}{T - t} + E\right) * \frac{1}{K2}$$

wherein D2 represents the second backlight duty ratio, T represents the frame period, D1 represents the first backlight duty ratio, t represents the first black frame insertion time, K2 represents the second current compensation coefficient, and E represents the liquid crystal compensation coefficient.

For example, the average value of the display gray scale of the current frame of image is 8, the average value of the display gray scale of the previous frame of image is 0, and the liquid crystal compensation coefficient is determined as 1% by looking up the lookup table shown in FIG. 7. The average value of the display gray scale of the current frame of image is greater than that of the previous frame of image, and because the backlight brightness within the liquid crystal response time is lower than a target brightness, compared with the case where there is no liquid crystal compensation coefficient, this embodiment further increases the second backlight duty ratio, to further improve the backlight brightness. The average value of the display gray scale of the current frame of image is 0, the average value of the display gray scale of the previous frame of image is 8, the liquid crystal compensation coefficient is determined as −1% by looking up the lookup table shown in FIG. 7, namely the average value of the display gray scale of the current frame of image is greater than that of the previous frame of image, and because the backlight brightness within the liquid crystal response time is higher than the target brightness, compared with the case where there is no liquid crystal compensation coefficient, this embodiment further reduces the second backlight duty ratio, to further reduce the backlight brightness.

Figure 10:
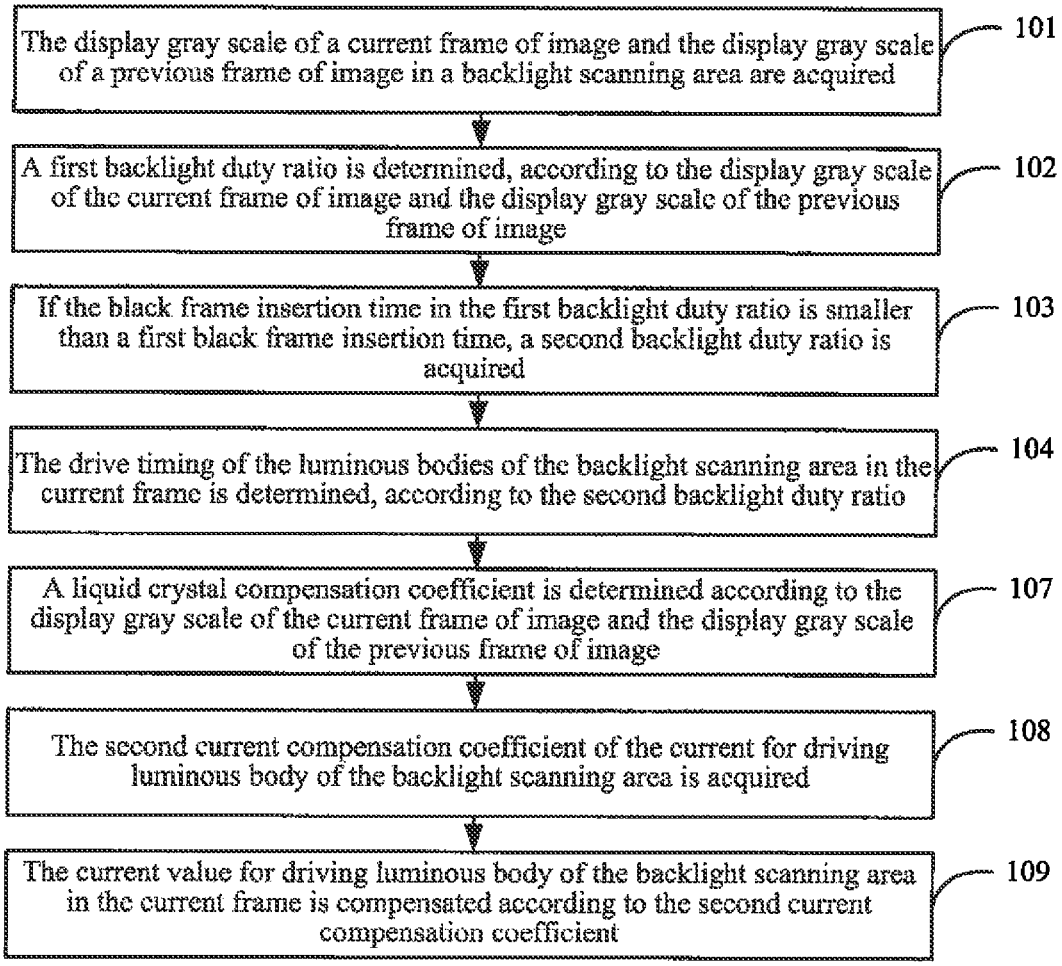
FIG. 10 is a schematic diagram of another backlight driving method, provided by one embodiment of the present invention.

As shown in FIG. 10, the method further includes the following operations.

Operation 107, a liquid crystal compensation coefficient is acquired according to the display gray scale of the current frame of image and the display gray scale of the previous frame of image, Operation 108, the second current compensation coefficient of the current for driving luminous body of the backlight scanning is acquired.

The second current compensation coefficient is a preset compensation coefficient. For example, the second current compensation coefficient is set to be 2, namely the current is improved by 2 times. Of course, for different displays, the second current compensation coefficient may also be set to be 1.5 or 3 or the like. The embodiment of the present invention is described in detail by taking the second current compensation coefficient being 2 as an example.

Operation 109, the current value for driving luminous body of the backlight scanning area in the current frame is compensated according to the second current compensation coefficient.

Reference may be made to the description of compensating the current value for driving luminous body of the backlight scanning area in the current frame by using the first current compensation coefficient in operation 106, which is not redundantly described herein.

Figure 11:
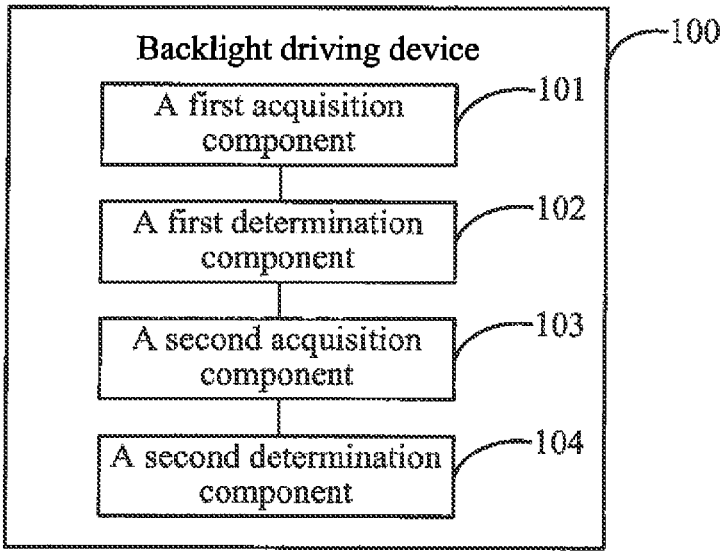
FIG. 11 is a schematic diagram of a backlight driving device, provided by one embodiment of the present invention.

It should be noted that in operation 103 of both the method shown in FIG. 10 and the method shown in FIG. 11, the second backlight duty ratio is acquired through the duty ratio algorithm, but the duty ratio algorithm shown in FIG. 10 is different from that shown in FIG. 11. The liquid crystal compensation coefficient is further introduced into the duty ratio algorithm shown in FIG. 11, to further accurately determine the duty ratio according to the display gray scale of the previous frame of image and the display gray scale of the current frame of image, and if the display gray scale of the current frame of image is greater than that of the previous frame of image, the duty ratio is further improved, to further improve the brightness; and if the display gray scale of the current frame of image is smaller than that of the previous frame of image, the duty ratio is slightly reduced, to further reduce the improved brightness and then improve the display quality.

Alternatively, if the black frame insertion time in the first backlight duty ratio is greater than or equal to the first black frame insertion time, then the drive timing of the backlight scanning area in the current frame is determined according to the first backlight duty ratio.

The cases in which the black frame insertion time in the first backlight duty ratio is greater than and equal to the first black frame insertion time will be described below, respectively.

In the case where the black frame insertion time in the first backlight duty ratio is equal to the first black frame insertion time, determining the drive timing of the luminous bodies of the backlight scanning area in the current frame according to the first backlight duty ratio includes:

determining the drive timing of the luminous bodies of the backlight scanning area in the current frame as follows: keeping a low level for the first black frame insertion time since the start of scanning of the first scan line of the display area corresponding to the backlight scanning area, and then keeping a high level till next frame of scanning begins on the first gate line of the display area corresponding to the backlight scanning area.

The drive timing when the black frame insertion time in the first backlight duty ratio is equal to the first black frame insertion time is the same as the drive timing when the black frame insertion time in the second backlight duty ratio is equal to the first black frame insertion time, and reference may be made to the specific description for the case where the black frame insertion time in the second backlight duty ratio is equal to the first black frame insertion time, which is not redundantly described herein.

In the case where the black frame insertion time in the first backlight duty ratio is greater than the first black frame insertion time, determining the drive timing of the luminous bodies of the backlight scanning area in the current frame according to the first backlight duty ratio includes:

determining the drive timing of the luminous bodies of the backlight scanning area in the current frame as follows: keeping a low level for a fourth time since the start of scanning of the first scan line of the display area corresponding to the backlight scanning area, and then keeping a high level till next frame of scanning begins on the first gate line of the display area corresponding to the backlight scanning area, wherein the fourth time is the black frame insertion time in the first backlight duty ratio;

or, determining the drive timing of the luminous bodies of the backlight scanning area in the current frame as follows: keeping a low level for the first black frame insertion time since the start of scanning of the first scan line of the display area corresponding to the backlight scanning area, then keeping a high level for a fifth time, and keeping a low level for a sixth time, wherein the fifth time is the lightening time in the first backlight duty ratio, and the sixth time is the difference between the black frame insertion time in the first backlight duty ratio and the first black frame insertion time.

In one embodiment, the drive timing when the black frame insertion time in the first backlight duty ratio is greater than the first black frame insertion time is the same as the drive timing when the black frame insertion time in the second backlight duty ratio is greater than the first black frame insertion time, and reference may be made to the specific description for the case where the black frame insertion time in the second backlight duty ratio is greater than the first black frame insertion time, which is not redundantly described herein.

Alternatively, the backlight is a direct type backlight or a side type backlight, and includes a plurality of backlight scanning areas along the image scanning direction.

When the backlight is the direct type backlight, each backlight scanning area may further include a plurality of subareas; and when the corresponding luminous bodies in each subarea may be driven independently, the luminous bodies in each subarea may also be subjected to driving adjustment, lightness compensation and the like. For the specific backlight driving method, reference may be made to the backlight driving method for the backlight scanning area provided by embodiments of the present invention.

The embodiments of the present invention provide a backlight driving device in correspondence to the backlight driving method. It should be noted that each functional component included by the device below may execute the corresponding operation in the above-mentioned method, so each functional component of the device in the following embodiments is not described in detail.

An embodiment of the present invention provides a backlight driving device. The driving device is used for driving the backlight of a liquid crystal display device, the backlight includes a plurality of backlight scanning areas, and each luminous body corresponding to each backlight scanning area is driven independently. As shown in FIG. 11, the backlight driving device 100 comprises:

A first acquisition component 101, configured to acquire the display gray scale of a current frame of image and the display gray scale of a previous frame of image in a backlight scanning area.

In one embodiment, the first acquisition component 101 acquires the display gray scale of the current frame of image and the display gray scale of the previous frame of image in the backlight scanning area, namely acquires the display gray scales of each display unit (pixel unit) in a display area corresponding to the backlight scanning area in the current frame of image and the previous frame of image. Acquisition of the display gray scale of the previous frame of image in the backlight scanning area may be acquisition of the display gray scale of the previous frame of image stored in a system.

A first determination component 102, configured to determine a first backlight duty ratio according to the display gray scale of the current frame of image and the display gray scale of the previous frame of image.

In one embodiment, the first determination component 102 calculates the average value of the display gray scale of the current frame of image and the average value of the display gray scale of the previous frame of image according to the display gray scale of the current frame of image and the display gray scale of the previous frame of image, and then determines the first backlight duty ratio by looking up a lookup table or the like according to the average value of the display gray scale of the current frame of image and the average value of the display gray scale of the previous frame of image.

A second acquisition component 103, configured to acquire a second backlight duty ratio if the black frame insertion time in the first backlight duty ratio is smaller than a first black frame insertion time, wherein the black frame insertion time in the second backlight duty ratio being greater than or equal to the first black frame insertion time, and the first black frame insertion time is not less than 20% of a frame period.

The frame period is a scanning period of scan lines on a display panel, and is related to the scanning frequency. For example, if the scanning frequency of the display panel is 120 Hz, the scanning period T is equal to $1/120$ Hz, about 8.3 ms. The backlight duty ratio is the ratio of the backlight (luminous body) lightening time in the frame period to the frame period, and the black frame insertion time in the backlight duty ratio is the difference between the frame period and the backlight lightening time in the frame period. For example, the backlight duty ratio is 30%, namely the backlight (luminous body) lightening time in the frame period is 8.3 ms*30%, that is 2.49 ms, and then the black frame insertion time in the backlight duty ratio is 8.3 ms−2.49 ms=5.81 ms.

The first black frame insertion time is not less than 20% of the frame period, taking the above-mentioned scanning period 8.3 ms as an example, namely the first black frame insertion time is not less than 8.3 ms*20% (which is about 1.66 ms). The first black frame insertion time being not less than 1.66 ms refers to that the first black frame insertion time may be any value more than 1.66 ms, e.g. the first black frame insertion time may be 2 ms or 2.2 ms. As when the first black frame insertion time is less than 20% of the frame period, the black frame insertion time in the frame period may be too short to alleviate the trailing phenomenon, in one embodiment of the present invention the first black frame insertion time is not less than 20% of the frame period. In addition, the longer the first black frame insertion time is, the shorter the corresponding lightening time is, so the overlong first black frame insertion time may affect the display effect. In one embodiment of the present invention, the first black frame insertion time is more than or equal to 20% of the frame period and less than or equal to 50% of the frame period. Further, when the first black frame insertion time is more than or equal to 30% of the frame period and less than or equal to 50% of the frame period, the black frame insertion effect and the display effect are optimal. Moreover, for different liquid crystal display devices, due to different scanning frequency, the corresponding frame period is different, and the first black frame insertion time is also different. In one embodiment of the present invention, the first black frame insertion time is a preset value corresponding to a display device. The above embodiments of the present invention are all described in detail by taking the example that the scanning frequency of the display device is 120 Hz, the scanning period is 8.3 ms and the preset first black frame insertion time is 2 ms.

By means of the above, if the black frame insertion time in the first backlight duty ratio is smaller than the first black frame insertion time, the second backlight duty ratio is acquired, the black frame insertion time in the second backlight duty ratio being greater than or equal to the first black frame insertion time. The trailing phenomenon may be alleviated by setting the black frame insertion time in the second backlight duty ratio to be greater than or equal to the first black frame insertion time. That is, in the case where the trailing phenomenon cannot be alleviated by the black frame insertion time in the first backlight duty ratio, the second backlight duty ratio is acquired. For example, the scanning frequency of the display device is 120 Hz, the scanning period is 8.3 ms, the preset first black frame insertion time is 2 ms, and if the first backlight duty ratio is 80%, the black frame insertion time in the first backlight duty ratio is 1.66 ms which is smaller than the first black frame insertion time. In this case, the second backlight duty ratio is acquired, the second backlight duty ratio may be 70%, and the black frame insertion time in the second backlight duty ratio is 2.49 ms which is greater than the first black frame insertion time, so that the trailing phenomenon may be alleviated by setting the black frame insertion time in the second backlight duty ratio in such a manner.

A second determination component 104, configured to determine the drive timing of the luminous bodies of the backlight scanning area in the current frame according to the second backlight duty ratio.

It should be noted that the drive timing of the luminous bodies of the backlight scanning area in the current frame includes the lightening (namely high level) and black frame insertion (namely low level) timing of the luminous bodies of the backlight scanning area in the current frame, and the lengths of the lightening time and black frame insertion time. Moreover, when the backlight duty ratio is determined, the lengths of the lightening time and black frame insertion time of the luminous bodies are determined. For example, when the backlight duty ratio is 70%, the lightening time of the luminous bodies in the second backlight duty ratio is 5.81 ms, and the black frame insertion time of the luminous bodies in the second backlight duty ratio is 2.49 ms. At the moment, black frame insertion is performed for 2.49 ms after the luminous bodies in the frame period are lightened for 5.81 ms, or the luminous bodies in the frame period are lightened for 5.81 ms after black frame insertion is performed for 2.49 ms, or the luminous bodies in the frame period are lightened for 5.81 ms after black frame insertion is performed for 1 ms and then black frame insertion is performed for 1.49 ms. In the case where the sum of the black frame insertion time of the luminous bodies in the frame period is 2.49 ms and the luminous bodies are lightened for 5.81 ms, the time length of each black frame insertion and lightening may take various different forms.

An embodiment of the present invention provides a backlight driving device, wherein the second acquisition component acquires the second backlight duty ratio, and determines the drive timing of the luminous bodies of the backlight scanning area in the current frame according to the second backlight duty ratio, when the black frame insertion time in the first backlight duty ratio, determined according to the display gray scale of the current frame of image and the display gray scale of the previous frame of image in the backlight scanning area, is too short and smaller than the first black frame insertion time, and can not achieve the black frame insertion effect, and alleviate the trailing phenomenon. Since the black frame insertion time in the second backlight duty ratio is greater than the first black frame insertion time, the trailing phenomenon may be alleviated by the drive timing of the luminous bodies of the backlight scanning area, which is determined by the second determination component according to the second backlight duty ratio.

Alternatively, in the case where the black frame insertion time in the second backlight duty ratio acquired by the second acquisition component 103 is equal to the first black frame insertion time:

the second determination component 104 is configured to determine the drive timing of the backlight scanning area in the current frame: keep low level (namely the backlight is turned off for black frame insertion) for the first black frame insertion time since the start of scanning of the first scan line of the display area corresponding to the backlight scanning area, and then keep high level (namely the backlight is lightened) till next frame of scanning begins on the first gate line of the display area corresponding to the backlight scanning area.

It should be noted that, since the backlight scanning area corresponds to the display area of the display panel, display of the display area refers to that the corresponding scan lines of the display area are sequentially turned on. In one embodiment of the present invention, the second determination component starts scanning from the display area corresponding to the first scan line of the backlight scanning area, namely takes the time of starting scanning of the first scan line of the display area corresponding to the backlight scanning area as a starting time of the drive timing of the backlight scanning area. Then the high level is kept till next frame of scanning begins on the first gate line of the display area corresponding to the backlight scanning area, namely the high level is kept till next frame of scanning begins, the total lightening and black frame insertion time of the luminous bodies being equal to a frame period.

When a scan line is scanned, the corresponding liquid crystals deflect, namely the liquid crystals respond; after the liquid crystals deflect to a certain angle, the angle is kept till the next frame of gate line is scanned; and within the deflecting time of the liquid crystal, the display effect is affected. According to the driving device provided by one embodiment of the present invention, the second determination component keeps the low level for the first black frame insertion time when the display area corresponding to the backlight scanning area begins to be scanned, namely black frame insertion is performed within the deflecting time of the liquid crystals, so as to solve the display problem brought by the deflection of the liquid crystal, and be favorable for further improvement of the display effect.

Figure 12:
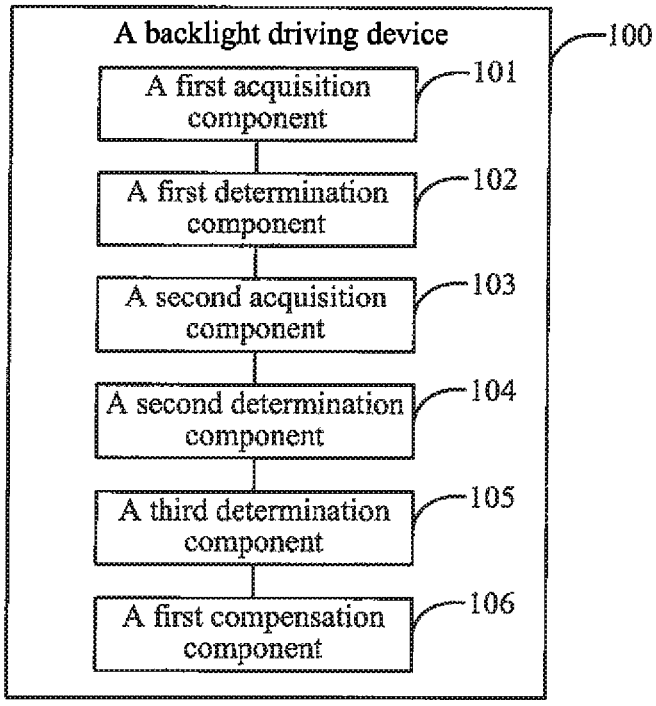
FIG. 12 is a schematic diagram of another backlight driving device, provided by one embodiment of the present invention.

Alternatively, as shown in FIG. 12, the backlight driving device 100 further includes the following components.

A third determination component 105, configured to determine the first current compensation coefficient of a current for driving luminous body of the backlight scanning area by using a current compensation algorithm, wherein the current compensation algorithm is:

$$K1 = \frac{T * D1}{T - t} * \frac{1}{D2}$$

wherein D2 represents the second backlight duty ratio, T represents the frame period, D1 represents the first backlight duty ratio, t represents the first black frame insertion time, and K1 represents the first current compensation coefficient.

A first compensation component 106, configured to compensate the current value for driving luminous body of the backlight scanning area in the current frame according to the first current compensation coefficient.

In one embodiment of the present invention, the black frame insertion time in the second backlight duty ratio is longer than that in the first backlight duty ratio, and compared with the first backlight duty ratio, the brightness of backlight scanning performed according to the second backlight duty ratio is lower than that performed according to the first backlight duty ratio. Accordingly, in one embodiment of the present invention, the first compensation component compensates the current value for driving luminous body of the backlight scanning area in the current frame according to the first current compensation coefficient, namely improves the current so as to improve the brightness of the backlight.

Figure 13:
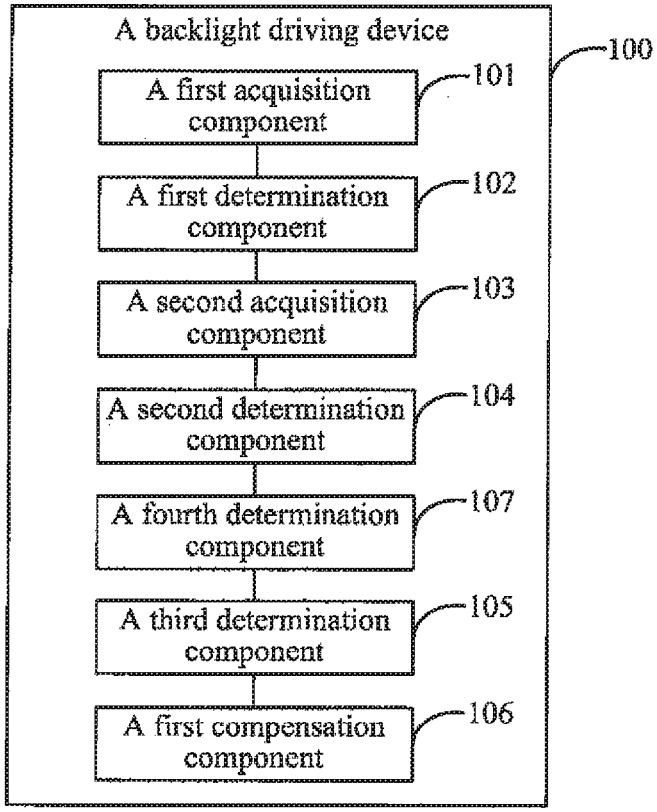
FIG. 13 is a schematic diagram of another backlight driving device, provided by one embodiment of the present invention.

Alternatively, as shown in FIG. 13, the driving device 100 for the backlight further includes one or more of the following components.

A fourth determination component 107, configured to determine a liquid crystal compensation coefficient according to the display gray scale of the current frame of image and the display gray scale of the previous frame of image.

In one embodiment, the fourth determination component 107 may obtain the average value of the display gray scale of the current frame of image and the average value of the display gray scale of the previous frame of image in the backlight scanning area according to the display gray scale of the current frame of image and the display gray scale of the previous frame of image in the backlight scanning area acquired by the first acquisition component 101, and determine the liquid crystal compensation coefficient, according to the average value of the display gray scale of the current frame of image and the average value of the display gray scale of the previous frame of image, by looking up a lookup table shown in FIG. 7. For example, the average value of the display gray scale of the current frame of image is 8, the average value of the display gray scale of the previous frame of image is 0, and the liquid crystal compensation coefficient is determined as 1% by looking up the lookup table shown in FIG. 7. That is, when the average value of the display gray scale of the current frame of image is greater than that of the previous frame of image, the liquid crystal compensation coefficient is more than 1, so that the current is improved.

A third determination component 105, configured to determine the first current compensation coefficient of a current for driving luminous body of the backlight scanning area by using a current compensation algorithm, wherein the current compensation algorithm is:

$$K1 = \left(\frac{T * D1}{T - t} + E\right) * \frac{1}{D2}$$

wherein D2 represents the second backlight duty ratio, T represents the frame period, D1 represents the first backlight duty ratio, t represents the first black frame insertion time, K1 represents the first current compensation coefficient, and E represents the liquid crystal compensation coefficient.

A first compensation component 106, configured to compensate the current value for driving luminous body of the backlight scanning area in the current frame according to the first current compensation coefficient.

Alternatively, in the case where the black frame insertion time in the second backlight duty ratio acquired by the second acquisition component 103 is greater than the first black frame insertion time, the first black frame insertion time is not more than 50% of the frame period.

The second determination component 104 may be configured to determine the drive timing of the luminous bodies of the backlight scanning area in the current frame as follows: keeping a low level for a first time since start of scanning of the first scan line of the display area corresponding to the backlight scanning area, and then keeping a high level till next frame of scanning begins on the first gate line of the display area corresponding to the backlight scanning area, wherein the first time is the black frame insertion time in the second backlight duty ratio.

For example, the second backlight duty ratio is 70%, the lightening time in the second backlight duty ratio is 5.81 ms, the black frame insertion time in the second backlight duty ratio is 2.49 ms, then the drive timing of the luminous bodies of the backlight scanning area in the current frame is determined according to the second backlight duty ratio as follows: since the start of scanning of the first scan line of the display area corresponding to the backlight scanning area, keeping a low level, namely performing black frame insertion on the backlight for 2.49 ms, then keeping a high level till next frame of scanning begins on the first gate line of the display area corresponding to the backlight scanning area, namely lightening the backlight for 5.81 ms. That is, only one-time black frame insertion is performed in the drive timing of the luminous bodies in the current frame, and the black frame insertion time is equal to the black frame insertion time in the second backlight duty ratio, so that the liquid crystals deflects within the black frame insertion time as far as possible, so as to solve the display problems brought by the deflection of the liquid crystals, and be favorable for further improving the display effect.

Or, the second determination component 104 may be configured to determine the drive timing of the luminous bodies of the backlight scanning area in the current frame as follows: keeping a low level for the first black frame insertion time since the start of scanning of the first scan line of the display area corresponding to the backlight scanning area, then keeping a high level for a second time, and keeping a low level for a third time, wherein the second time is the lightening time in the second backlight duty ratio, and the third time is the difference between the black frame insertion time in the second backlight duty ratio and the first black frame insertion time.

For example, the second backlight duty ratio is 70%, the lightening time in the second backlight duty ratio is 5.81 ms, the black frame insertion time in the second backlight duty ratio is 2.49 ms, and the first black frame insertion time is 2 ms, then the drive timing of the luminous bodies of the backlight scanning area in the current frame according to the second backlight duty ratio is determined as follows: since the start of scanning of the first scan line of the display area corresponding to the backlight scanning area, keeping a low level, namely performing black frame insertion on the backlight for 2 ms; then keeping a high level for the second time, namely lightening the backlight for 5.81 ms; and keeping a low level for the third time, namely performing black frame insertion again on the backlight for 0.49 ms.

It should be noted that the third determination component 105 in both the device shown in FIG. 12 and the device shown in FIG. 13 is configured to determine the first current compensation coefficient of the current for driving luminous body of the backlight scanning area by using the current compensation algorithm, but the third determination component 105 shown in FIG. 13 is different from the third determination component 105 shown in FIG. 12. The liquid crystal compensation coefficient is further introduced into the third determination component 105 shown in FIG. 13, to further accurately determine the first compensation coefficient of the current for driving luminous body according to the display gray scale of the previous frame of image and the display gray scale of the current frame of image, if the display gray scale of the current frame of image is greater than that of the previous frame of image, the first compensation coefficient is further improved, to further improve the brightness; and if the display gray scale of the current frame of image is smaller than that of the previous frame of image, the first compensation coefficient is slightly reduced, to further reduce the brightness of compensation and improve the display quality.

In one embodiment of the present invention, the second acquisition component 103 is configured to acquire the second backlight duty ratio through a duty ratio algorithm, wherein the duty ratio algorithm is as follows:

$$D2 = \frac{T * D1}{T - t} * \frac{1}{K2}$$

wherein D2 represents the second backlight duty ratio, T represents the frame period, D1 represents the first backlight duty ratio, t represents the first black frame insertion time, and K2 represents the second current compensation coefficient.

Figure 14:
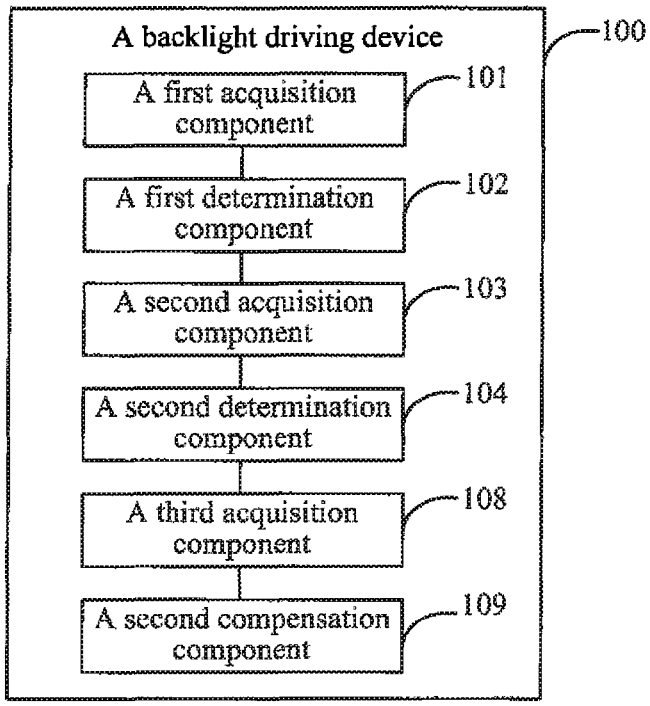
FIG. 14 is a schematic diagram of another backlight driving device, provided by one embodiment of the present invention.

As shown in FIG. 14, the backlight driving device 100 further includes:

A third acquisition component 108, configured to acquire the second current compensation coefficient of the current for driving luminous body of the backlight scanning area, wherein the second current compensation coefficient is a preset compensation coefficient.

For example, the second current compensation coefficient is set to 2, namely the current is improved by 2 times. Of course, for different displays, the second current compensation coefficient may also be set to be 1.5 or 3 or the like. The embodiment of the present invention is described in detail by taking the second current compensation coefficient being 2 as an example.

A second compensation component 109, configured to compensate the current value for driving luminous body of the backlight scanning area in the current frame by using the second current compensation coefficient.

In one embodiment, reference may be made to the description of the above first compensation component 106 for compensating the current value for driving luminous body of the backlight scanning area in the current frame according to the first current compensation coefficient, which is not redundantly described herein.

In one embodiment of the present invention, the second acquisition component 103 is configured to acquire the second backlight duty ratio through a duty ratio algorithm, wherein the duty ratio algorithm is as follows:

$$D2 = \left(\frac{T * D1}{T - t} + E\right) * \frac{1}{K2}$$

wherein D2 represents the second backlight duty ratio, T represents the frame period, D1 represents the first backlight duty ratio, t represents the first black frame insertion time, K2 represents the second current compensation coefficient, and E represents the liquid crystal compensation coefficient.

Figure 15:
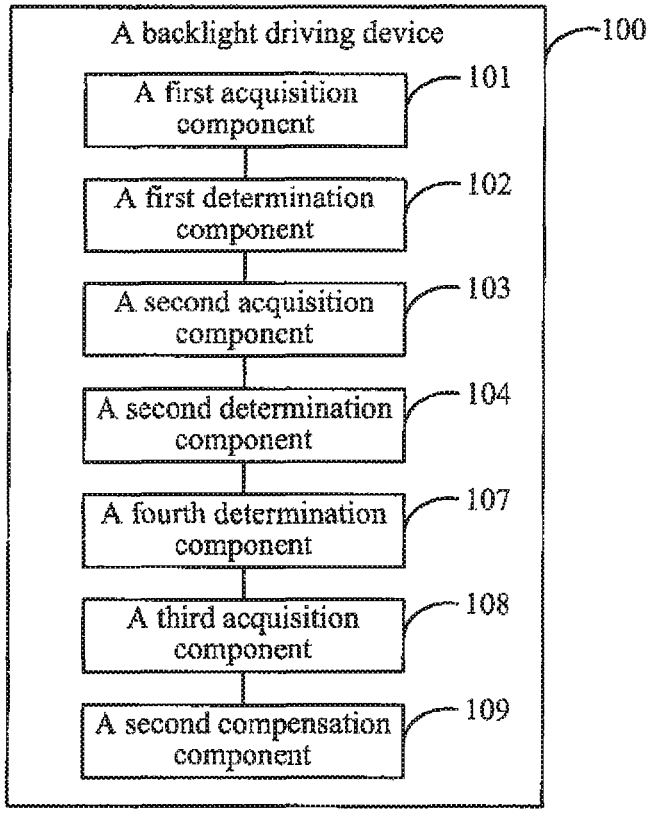
FIG. 15 is a schematic diagram of another backlight driving device, provided by one embodiment of the present invention.

As shown in FIG. 15, the backlight driving device 100 further includes one or more of the following components.

A fourth acquisition component 107, configured to acquire a liquid crystal compensation coefficient according to the display gray scale of the current frame of image and the display gray scale of the previous frame of image.

A third acquisition component 108, configured to acquire the second current compensation coefficient of the current for driving luminous body of the backlight scanning area, The second current compensation coefficient is a preset compensation coefficient. For example, the second current compensation coefficient is set to be 2, namely the current is improved by 2 times. Of course, for different displays, the second current compensation coefficient may also be set to be 1.5 or 3 or the like. The embodiment of the present invention is described in detail by taking the second current compensation coefficient being 2 as an example.

A second compensation component 109, configured to compensate the current value for driving luminous body of the backlight scanning area in the current frame according to the second current compensation coefficient.

It should be noted that, the second acquisition component 103 in both the device shown in FIG. 14 and the device shown in FIG. 15 is configured to acquire the second backlight duty ratio through the duty ratio algorithm, but the duty ratio algorithm shown in FIG. 15 is different from that shown in FIG. 14. The liquid crystal compensation coefficient is further introduced into the duty ratio algorithm shown in FIG. 15, to further accurately determine the duty ratio according to the display gray scale of the previous frame of image and the display gray scale of the current frame of image, if the display gray scale of the current frame of image is greater than that of the previous frame of image, the duty ratio is further improved, to further improve the brightness; and if the display gray scale of the current frame of image is smaller than that of the previous frame of image, the duty ratio is slightly reduced, to further reduce the improved brightness and then improve the display quality.

Alternatively, if the black frame insertion time in the first backlight duty ratio is greater than or equal to the first black frame insertion time, the second determination component 104 is configured to determine the drive timing of the luminous bodies of the backlight scanning area in the current frame according to the first backlight duty ratio.

The cases in which the black frame insertion time in the first backlight duty ratio is greater than and equal to the first black frame insertion time will be described below, respectively.

In the case where the black frame insertion time in the first backlight duty ratio is equal to the first black frame insertion time, the second determination component 104 is configured to determine the drive timing of the luminous bodies of the backlight scanning area in the current frame according to the first backlight duty ratio, including:

determining the drive timing of the luminous bodies of the backlight scanning area in the current frame as follows: keeping a low level for the first black frame insertion time since the start of scanning of the first scan line of the display area corresponding to the backlight scanning area, and then keeping a high level till next frame of scanning begins on the first gate line of the display area corresponding to the backlight scanning area.

In one embodiment, the drive timing when the black frame insertion time in the first backlight duty ratio is equal to the first black frame insertion time is the same as the drive timing when the black frame insertion time in the second backlight duty ratio is equal to the first black frame insertion time, and reference may be made to the specific description of the case where the black frame insertion time in the second backlight duty ratio is equal to the first black frame insertion time, which is not redundantly described herein.

In the case where the black frame insertion time in the first backlight duty ratio is greater than the first black frame insertion time, the second determination component 104 is configured to determine the drive timing of the luminous bodies of the backlight scanning area in the current frame according to the first backlight duty ratio, including:

determining the drive timing of the luminous bodies of the backlight scanning area in the current frame as follows: keeping a low level for a fourth time since the start of scanning of the first scan line of the display area corresponding to the backlight scanning area, and then keeping a high level till next frame of scanning begins on the first gate line of the display area corresponding to the backlight scanning area, wherein the fourth time is the black frame insertion time in the first backlight duty ratio.

Or, determining the drive timing of the luminous bodies of the backlight scanning area in the current frame as follows: keeping a low level for the first black frame insertion time since start of scanning of the first scan line of the display area corresponding to the backlight scanning area, then keeping a high level for a fifth time, and keeping a low level for a sixth time, wherein the fifth time is the lightening time in the first backlight duty ratio, and the sixth time is the difference between the black frame insertion time in the first backlight duty ratio and the first black frame insertion time.

In one embodiment, the drive timing when the black frame insertion time in the first backlight duty ratio is greater than the first black frame insertion time is the same as the drive timing when the black frame insertion time in the second backlight duty ratio is greater than the first black frame insertion time, and reference may be made to the specific description of the case where the black frame insertion time in the second backlight duty ratio is greater than the first black frame insertion time, which is not redundantly described herein.

Figure 16:
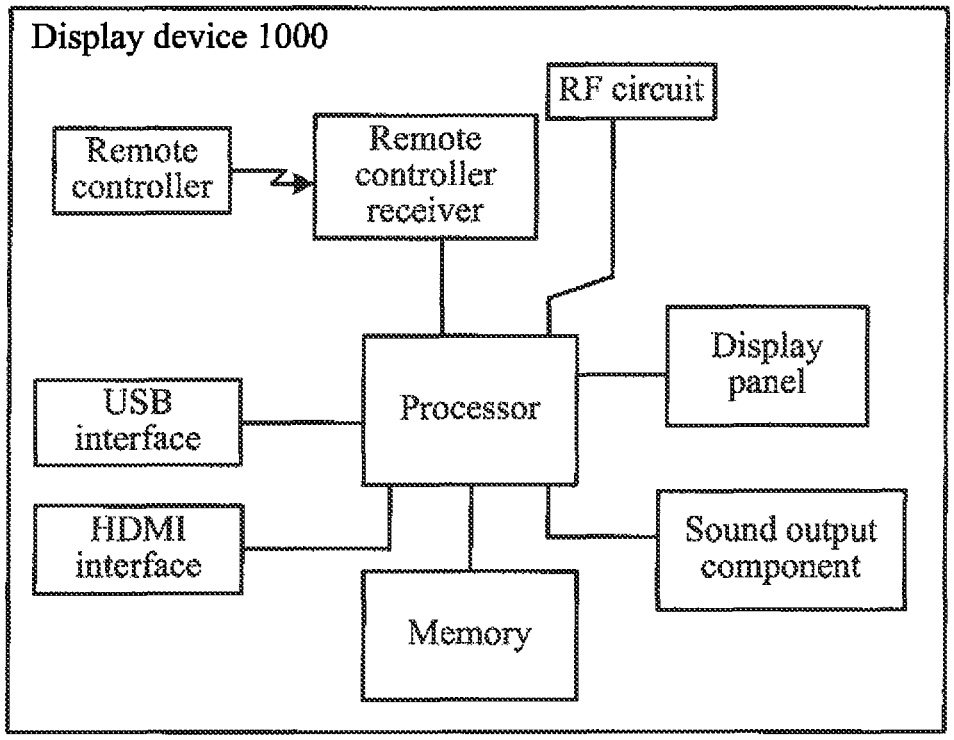
FIG. 16 is a structural schematic diagram of a display device provided by one embodiment of the present invention.

An embodiment of the present invention provides a display device, which may be a liquid crystal display device or other display device, or any product or component with display function included in a display device such as a television, a digital camera, a mobile phone, a tablet computer and so on. The display device 1000 may include a memory, an input component, an output component, one or more processors and the like. It could be understood by those skilled in the art that the display device is not limited to the structure of the display device shown in FIG. 16, and may include more or less components than those shown in the figure or combine some components or have different component arrangement.

The memory may be used for storing software program codes and modules, and the processors may perform various functional applications and data processing by executing the software program codes and modules stored in the memory. The memory may include a high-speed random access memory or a nonvolatile memory, e.g. at least one disk storage device, a flash device or other volatile solid-state storage device. In addition, the memory may also include a memory controller, configured to provide access to the memory by the processors and the input component.

The processor is a control center of the display device 1000, is connected with each part of the whole display device by using various interfaces and circuits, and is configured to execute various functions of the display device 1000 and process data by operating or executing the software programs and/or modules stored in the memory and calling the data stored in the memory, so as to monitor the whole display device. Alternatively, the processor may include one or more processing cores. Alternatively, the processor may integrate an application processor and a modulation-demodulation processor, wherein the application processor is mainly used for processing an operating system, a user interface, application programs and the like, and the modulation-demodulation processor is mainly used for processing wireless communication. It could be understood that the modulation-demodulation processor may also not be integrated in the processor.

The display device 1000 may include a television broadcast receiver, a high-definition multimedia interface (HDMI interface), a USB interface and an input component such as an audio-video input structure, and the input component may further include a remote controller receiver for receiving signals transmitted by a remote controller. In addition, the input component may further include a touch-sensitive surface and other input equipment; the touch-sensitive surface may be implemented in various ways such as resistance type, capacitance type, infrared, surface acoustic wave and the like; and the other input equipment may include but not limited to one or more of a physical keyboard, functional keys (such as a volume control key, a switch key and the like), a trackball, a mouse, an operating lever and the like.

The output component is configured to output sound signals, video signals, alarm signals, vibration signals and the like. The output component may include a display panel, a sound output module and the like. The display panel may be configured to display information input by a user or information provided to the user and various graphical user interfaces of the display device 1000, and these graphical user interfaces may be composed of graphic, text, icon, video and any combination thereof. For example, the display panel may be an LCD (Liquid Crystal Display), an OLED (Organic Light-Emitting Diode), a flexible display, a three-dimensional display, a CRT (Cathode Ray Tube), a plasma display panel or the like.

The display device 1000 may further include at least one kind of sensor (not shown in the figure), e.g. a light sensor, a motion sensor or other sensor. The light sensor may include an ambient light sensor and a proximity sensor, wherein the ambient light sensor may adjust the brightness of the display panel according to the brightness of ambient light, and the proximity sensor may turn off the display panel and/or backlight when the display device 1000 moves to a certain position. The display device 1000 may further be configured with a gyroscope, a barometer, a hygrometer, a thermometer and other sensor such as infrared sensor.

The display device 1000 may further include an audio circuit (not shown in the figure), and a loudspeaker or microphone may provide an audio interface between the user and the display device 1000. The audio circuit may transmit electrical signals converted from received audio data to the loudspeaker, and the electrical signals are converted into sound signals by the loudspeaker for outputting; and on the other hand, the microphone converts the acquired sound signals into electrical signals, the electrical signals are received by the audio circuit and then converted into audio data, and the audio data is output to the processor, processed and then transmitted to for example another display device, or the audio data is output to the memory for further processing. The audio circuit may further include earplug jacks, for providing communication between an external earphone and the display device 1000.

In addition, the display device 1000 may further include an RF (Radio Frequency) circuit. The RF circuit may be used for receiving and transmitting signals. Generally, the RF circuit includes but not limited to an antenna, at least one amplifier, a tuner, one or more oscillators, a transceiver, a coupler, an LNA (Low Noise Amplifier), a duplexer and the like. In addition, the display device 1000 may further include a camera, a Bluetooth module and the like.

Moreover, the display device 1000 may further include a WiFi (wireless fidelity) module (not shown in the figure). WiFi belongs to a short-distance wireless transmission technology, and the display device 1000 may assist the user in transceiving E-mail, browsing webs, accessing streaming media and the like through the WiFi module, so that it provides a wireless broadband Internet access for the user.

Described above are merely specific embodiments of the present invention, but the protection scope of the present invention is not limited thereto. Variations or substitutions that are readily conceivable by those skilled in the art within the technical scope disclosed in the present invention shall fall within the protection scope of the present invention. Accordingly, the protection scope of the present invention is subjected to the protection scope of the claims.

The invention claimed is:

1. A backlight driving method for driving a backlight of a liquid crystal display device, the backlight comprising a plurality of backlight scanning areas, wherein each luminous body corresponding to each backlight scanning area is driven independently, and the driving method comprising:

acquiring display gray scale of a current frame of image and display gray scale of a previous frame of image in a backlight scanning area;

determining a first backlight duty ratio according to the display gray scale of the current frame of image and the display gray scale of the previous frame of image;

if black frame insertion time in the first backlight duty ratio is smaller than a preset first black frame insertion time, acquiring a second current compensation coefficient of a current for driving luminous body of the backlight scanning area, wherein the second current compensation coefficient is a preset compensation coefficient; and acquiring the second backlight duty ratio according to the first backlight duty ratio, a preset frame period, the first backlight duty ratio and the second current compensation coefficient; and determining drive timing of luminous bodies of the backlight scanning area in the current frame according to the second backlight duty ratio;

compensating current value for driving luminous body of the backlight scanning area in the current frame according to the second current compensation coefficient;

wherein black frame insertion time in the second backlight duty ratio is greater than or equal to the preset first black frame insertion time, and the preset first black frame insertion time is not less than 20% of the preset frame period.

2. The method according to claim 1, wherein in the case where the black frame insertion time in the second backlight duty ratio is equal to the preset first black frame insertion time, the determining the drive timing of the luminous bodies of the backlight scanning area in the current frame according to the second backlight duty ratio comprises:

determining the drive timing of the luminous bodies of the backlight scanning area in the current frame as follows: keeping a low level for the preset first black frame insertion time since start of scanning of first scan line of display area corresponding to the backlight scanning area, and then keeping a high level till next frame of scanning begins on the first gate line of the display area corresponding to the backlight scanning area.

3. The method according to claim 1, wherein in the case where the black frame insertion time in the second backlight duty ratio is greater than the preset first black frame insertion time, the preset first black frame insertion time is not more than 50% of the preset frame period; and the determining the drive timing of the luminous bodies of the backlight scanning area in the current frame according to the second backlight duty ratio comprises:

determining the drive timing of the luminous bodies of the backlight scanning area in the current frame as follows: keeping a low level for a first time since start of scanning of first scan line of display area corresponding to the backlight scanning area, and then keeping a high level till next frame of scanning begins on the first gate line of the display area corresponding to the backlight scanning area, wherein the first time is the black frame insertion time in the second backlight duty ratio; or, determining the drive timing of the luminous bodies of the backlight scanning area in the current frame as follows: keeping a low level for the preset first black frame insertion time since start of scanning of the first scan line of the display area corresponding to the backlight scanning area, then keeping a high level for a second time, and keeping a low level for a third time; wherein the second time is lightening time in the second backlight duty ratio, and the third time is difference between the black frame insertion time in the second backlight duty ratio and the preset first black frame insertion time.

4. The method according to claim 1, wherein the acquiring the second backlight duty ratio according to the first backlight duty ratio, a preset frame period, the first backlight duty ratio and the second current compensation coefficient comprising: acquiring the second backlight duty ratio through a duty ratio algorithm;

wherein the duty ratio algorithm is as follows:

$$D2 = \frac{T * D1}{T - t} * \frac{1}{K2}$$

wherein D2 represents the second backlight duty ratio, T represents the preset frame period, D1 represents the first backlight duty ratio, t represents the preset first black frame insertion time, and K2 represents the second current compensation coefficient.

5. The method according to claim 1, wherein if black frame insertion time in the first backlight duty ratio is greater than or equal to the preset first black frame insertion time, determining drive timing of luminous bodies of the backlight scanning area in the current frame according to the first backlight duty ratio.

6. The method according to claim 1, wherein the preset first black frame insertion time is not less than 30% of the preset frame period and not more than 50% of the preset frame period.

7. The method according to claim 1, further comprising:

acquiring a liquid crystal compensation coefficient according to the display gray scale of a current frame of image and display gray scale of a previous frame of image in a backlight scanning area;

acquiring the second backlight duty ratio further according to the liquid crystal compensation.

8. The method according to claim 7, wherein the acquiring the second backlight duty ratio comprising: acquiring the second backlight duty ratio through a duty ratio algorithm;

wherein the preset duty ratio algorithm is as follows:

$$D2 = \left(\frac{T * D1}{T - t} + E\right) * \frac{1}{K2}$$

wherein D2 represents the second backlight duty ratio, T represents the preset frame period, D1 represents the first backlight duty ratio, t represents the preset first black frame insertion time, K2 represents the second current compensation coefficient, and E represents the liquid crystal compensation coefficient.

9. The method according to claim 8, wherein the liquid crystal compensation coefficient E is obtained by looking up a lookup table according to an average value of the display gray scale of the current frame of image and an average value of the display gray scale of the previous frame of image;

when the average value of the display gray scale of the previous frame of image is smaller than the average value of the display gray scale of the current frame of image, the liquid crystal compensation coefficient E is positive, a compensation of brightness caused by the liquid crystal compensation coefficient E is relatively high;

when the average value of the display gray scale of the previous frame of image is greater than the average value of the display gray scale of the current frame of image, the liquid crystal compensation coefficient E is negative, the compensation of brightness is relatively low, and the smaller E is, namely the larger the average value of the display gray scale of the previous frame of image is than that of the current frame of image, the smaller the compensation of brightness is.

10. A display device, comprising:

one or more processors;

one or more computer-readable memories, wherein the one or more computer-readable memories storing instruction codes, the instruction codes are executable by the one or more processors to drive a backlight of liquid crystal of the display device, the backlight comprises a plurality of backlight scanning areas, and each luminous body corresponding to each backlight scanning area is driven independently, wherein driving a backlight of liquid crystal of the display device comprises:

acquiring display gray scale of a current frame of image and display gray scale of a previous frame of image in a backlight scanning area;

determining a first backlight duty ratio according to the display gray scale of the current frame of image and the display gray scale of the previous frame of image;

if black frame insertion time in the first backlight duty ratio is smaller than a preset first black frame insertion time, acquiring a second current compensation coefficient of a current for driving luminous body of the backlight scanning area, wherein the second current compensation coefficient is a preset compensation coefficient; and acquiring the second backlight duty ratio according to the first backlight duty ratio, a preset frame period, the first backlight duty ratio and the second current compensation coefficient; and determining drive timing of luminous bodies of the backlight scanning area in the current frame according to the second backlight duty ratio;

compensating current value for driving luminous body of the backlight scanning area in the current frame according to the second current compensation coefficient;

wherein black frame insertion time in the second backlight duty ratio is greater than or equal to the preset first black frame insertion time, and the preset first black frame insertion time is not less than 20% of the preset frame period.

11. The device according to claim 10, wherein in the case where the black frame insertion time in the second backlight duty ratio is equal to the preset first black frame insertion time, the determining the drive timing of the luminous bodies of the backlight scanning area in the current frame according to the second backlight duty ratio comprises:

determining the drive timing of the luminous bodies of the backlight scanning area in the current frame as follows: keeping a low level for the preset first black frame insertion time since start of scanning of first scan line of display area corresponding to the backlight scanning area, and then keeping a high level till next frame of scanning begins on the first gate line of the display area corresponding to the backlight scanning area.

12. The device according to claim 10, wherein in the case where the black frame insertion time in the second backlight duty ratio is greater than the preset first black frame insertion time, the preset first black frame insertion time is not more than 50% of the preset frame period; and the determining the drive timing of the luminous bodies of the backlight scanning area in the current frame according to the second backlight duty ratio comprises:

determining the drive timing of the luminous bodies of the backlight scanning area in the current frame as follows: keeping a low level for a first time since start of scanning of first scan line of display area corresponding to the backlight scanning area, and then keeping a high level till next frame of scanning begins on the first gate line of the display area corresponding to the backlight scanning area, wherein the first time is the black frame insertion time in the second backlight duty ratio; or, determining the drive timing of the luminous bodies of the backlight scanning area in the current frame as follows: keeping a low level for the preset first black frame insertion time since start of scanning of the first scan line of the display area corresponding to the backlight scanning area, then keeping a high level for a second time, and keeping a low level for a third time; wherein the second time is lightening time in the second backlight duty ratio, and the third time is difference between the black frame insertion time in the second backlight duty ratio and the preset first black frame insertion time.

13. The device according to claim 10, wherein the acquiring the second backlight duty ratio according to the first backlight duty ratio, a preset frame period, the first backlight duty ratio and the second current compensation coefficient comprising: acquiring the second backlight duty ratio through a duty ratio algorithm wherein the duty ratio algorithm is as follows:

$$D2 = \frac{T * D1}{T - t} * \frac{1}{K2}$$

wherein D2 represents the second backlight duty ratio, T represents the preset frame period, D1 represents the first backlight duty ratio, t represents the preset first black frame insertion time, and K2 represents the second current compensation coefficient.

14. The device according to claim 10, wherein if black frame insertion time in the first backlight duty ratio is greater than or equal to the preset first black frame insertion time, determining drive timing of luminous bodies of the backlight scanning area in the current frame according to the first backlight duty ratio.

15. The device according to claim 10, wherein the preset first black frame insertion time is not less than 30% of the preset frame period and not more than 50% of the preset frame period.

16. The device according to claim 10, wherein the driving a backlight of liquid crystal of the display device further comprising:

acquiring a liquid crystal compensation coefficient according to the display gray scale of a current frame of image and display gray scale of a previous frame of image in a backlight scanning area;

acquiring the second backlight duty ratio further according to the liquid crystal compensation.

17. The device according to claim 16, wherein the acquiring the second backlight duty ratio comprising: acquiring the second backlight duty ratio through a duty ratio algorithm;

wherein the preset duty ratio algorithm is as follows:

$$D2 = \left(\frac{T * D1}{T - t} + E\right) * \frac{1}{K2}$$

wherein D2 represents the second backlight duty ratio, T represents the preset frame period, D1 represents the first backlight duty ratio, t represents the preset first black frame insertion time, K2 represents the second current compensation coefficient, and E represents the liquid crystal compensation coefficient.

18. The device according to claim 17, wherein the liquid crystal compensation coefficient E is obtained by looking up a lookup table according to an average value of the display gray scale of the current frame of image and an average value of the display gray scale of the previous frame of image;

when the average value of the display gray scale of the previous frame of image is smaller than the average value of the display gray scale of the current frame of image, the liquid crystal compensation coefficient E is positive, a compensation of brightness caused by the liquid crystal compensation coefficient E is relatively high;

when the average value of the display gray scale of the previous frame of image is greater than the average value of the display gray scale of the current frame of image, the liquid crystal compensation coefficient E is negative, the compensation of brightness is relatively low, and the smaller E is, namely the larger the average value of the display gray scale of the previous frame of image is than that of the current frame of image, the smaller the compensation of brightness is.

19. A non-transitory computer-readable storage medium, storing computer-readable program codes, wherein the computer-readable program codes is executable by one or more processors to drive a backlight of the liquid crystal display device, wherein driving a backlight of liquid crystal of the display device comprises:

acquiring display gray scale of a current frame of image and display gray scale of a previous frame of image in a backlight scanning area;

determining a first backlight duty ratio according to the display gray scale of the current frame of image and the display gray scale of the previous frame of image;

if black frame insertion time in the first backlight duty ratio is smaller than a preset first black frame insertion time, acquiring a second current compensation coefficient of a current for driving luminous body of the backlight scanning area, wherein the second current compensation coefficient is a preset compensation coefficient; and acquiring the second backlight duty ratio according to the first backlight duty ratio, a preset frame period, the first backlight duty ratio and the second current compensation coefficient:

determining drive timing of luminous bodies of the backlight scanning area in the current frame according to the second backlight duty ratio;

compensating current value for driving luminous body of the backlight scanning area in the current frame according to the second current compensation coefficient;

wherein black frame insertion time in the second backlight duty ratio is greater than or equal to the preset first black frame insertion time, and the preset first black frame insertion time is not less than 20% of the preset frame period.

* * * * *